US008080511B2

(12) United States Patent
Dreyer et al.

(10) Patent No.: US 8,080,511 B2
(45) Date of Patent: Dec. 20, 2011

(54) FORMULATIONS COMPRISING WATER-SOLUBLE GRANULATES

(75) Inventors: Pierre Dreyer, Blodelsheim (FR); Elke Haiss, Murg (DE); Laure Iltis, Soultz (FR); Petr Kvita, Reinach (CH); Ullrich Menge, Grenzach-Wyhlen (DE)

(73) Assignee: BASF SE, Ludwigshafen (DE)

( * ) Notice: Subject to any disclaimer, the term of this patent is extended or adjusted under 35 U.S.C. 154(b) by 361 days.

(21) Appl. No.: 10/526,093

(22) PCT Filed: Aug. 26, 2003

(86) PCT No.: PCT/EP03/09409

§ 371 (c)(1),
(2), (4) Date: Feb. 23, 2005

(87) PCT Pub. No.: WO2004/022693

PCT Pub. Date: Mar. 18, 2004

(65) Prior Publication Data

US 2005/0227891 A1 Oct. 13, 2005

(30) Foreign Application Priority Data

Sep. 4, 2002 (EP) ..... 02405766

(51) Int. Cl.

| | |
|---|---|
| ***C11D 1/00*** | (2006.01) |
| ***C11D 3/20*** | (2006.01) |
| ***C11D 3/28*** | (2006.01) |
| ***C11D 3/37*** | (2006.01) |

(52) U.S. Cl. ..... 510/312; 510/309; 510/361; 510/444; 510/445; 510/475; 510/476; 510/477; 510/488; 510/499; 510/500; 510/509; 510/492; 510/495

(58) Field of Classification Search ..... 510/312, 510/361, 444, 445, 477, 488, 499, 500, 509, 510/309, 475, 476, 492, 495
See application file for complete search history.

(56) References Cited

U.S. PATENT DOCUMENTS

| | | | | |
|---|---|---|---|---|
| 4,097,418 | A | 6/1978 | Rolfes | 252/531 |
| 4,299,717 | A * | 11/1981 | Cottrell et al. | 510/276 |
| 4,394,125 | A | 7/1983 | Hölzle et al. | 8/103 |
| 4,548,610 | A | 10/1985 | Preiswerk et al. | 8/101 |
| 4,762,636 | A | 8/1988 | Balliello et al. | 252/95 |
| 4,961,755 | A | 10/1990 | Bruttel et al. | 8/526 |
| 4,990,280 | A | 2/1991 | Thorengaard et al. | 252/95 |
| 5,916,481 | A | 6/1999 | Willey | 252/186.21 |
| 6,291,412 | B1 | 9/2001 | Kvita et al. | 510/301 |
| 6,339,055 | B1 | 1/2002 | Brooker et al. | 510/301 |
| 6,407,049 | B1 | 6/2002 | Willey et al. | 510/301 |
| 2003/0017959 | A1 * | 1/2003 | Baeck et al. | 510/445 |
| 2003/0195134 | A1 * | 10/2003 | Vandijk et al. | 510/446 |
| 2003/0232734 | A1 * | 12/2003 | Kitko et al. | 510/311 |

FOREIGN PATENT DOCUMENTS

| | | |
|---|---|---|
| AU | 747856 | 5/2002 |
| CH | 659082 | 12/1986 |
| DE | 3430773 | 3/1985 |
| EP | 0124478 | 11/1984 |
| EP | 0899325 | 3/1999 |
| EP | 0959123 | 11/1999 |

OTHER PUBLICATIONS

Derwent Abstr. 87-007484/02 for CH 659082 (1986).
Derwent Abstr. 85-069674/12 for DE 3430773 (1985).

* cited by examiner

*Primary Examiner* — Gregory Delcotto
(74) *Attorney, Agent, or Firm* — Shiela A. Loggins

(57) ABSTRACT

The present invention relates to formulations comprising water-soluble granulates of phthalocyanine compounds, to a process for the preparation thereof, and to the use thereof in washing agent and washing agent additive formulations.

22 Claims, No Drawings

FORMULATIONS COMPRISING WATER-SOLUBLE GRANULATES

The present invention relates to formulations comprising water-soluble non-encapsulated granulates of phthalocyanine compounds, to a process for the preparation thereof, and to the use thereof in washing agent and washing agent additive formulations.

The formulations according to the invention may be liquid, solid, paste-like or gel-like.

The formulations, especially washing agent compositions but also washing agent additives or additive concentrates, for example pre- and/or after-treatment agents, stain-removing salt, washing-power enhancers, fabric conditioners, bleaching agents, UV-protection enhancers etc., may be in any known and customary form, especially in the form of powders, (super-)compact powders, in the form of single- or multi-layer tablets (tabs), bars, blocks, sheets or pastes, or in the form of pastes, gels or liquids used in capsules or in pouches (sachets).

It is also possible for powders to be used in suitable sachets or pouches.

Water-soluble phthalocyanine compounds, especially zinc and aluminium phthalocyanine-sulfonates, are frequently used as photoactivators in washing agent preparations.

EP 333 270 describes solid microcapsules of phthalocyanine photoactivators, which comprise at least 38% of an encapsulating material.

EP 959 123 describes granulates based on anionic dispersing agents in conjunction with a water-soluble organic polymer.

EP 323 407 describes encapsulated granules comprising an active ingredient.

EP 124 478 describes a process for the preparation of solid photoactivator preparations, which comprises passing a crude solution of the photoactivators through a modified membrane and subjecting the resulting concentrated aqueous solution to a gentle drying process.

EP 236 270 describes a process for the preparation of structures comprising an active substance and their use as speckles, having an average diameter of 0.5-1.0 mm.

However, owing to the fact that such photoactivators dissolve too slowly in water, problems often arise, especially when there is inadequate mixing of the washing liquor, because the coloured photoactivators stain the laundry.

It has now been found that the rate at which granules of phthalocyanine compounds dissolve in water can be improved further by a novel composition. This is achieved by the addition of at least one inorganic salt and/or at least one low-molecular-weight organic acid. Despite their high dissolution rate, such non-encapsulated granules, having a distribution of ingredients that is substantially homogeneous, have a high level of durability in non-ionic surfactants (NIO surfactants).

The present invention accordingly relates to formulations comprising at least one granulate containing a) from 2 to 50% by weight of at least one water-soluble phthalocyanine compound, based on the total weight of the granulate, b) from 10 to 60% by weight of at least one anionic dispersing agent and/or at least one water-soluble organic polymer, based on the total weight of the granulate, c) from 15 to 75% by weight of at least one inorganic salt and/or at least one low-molecular-weight organic acid or a salt thereof, based on the total weight of the granulate, d) from 0 to 10% by weight of at least one further additive, based on the total weight of the granulate, and e) from 3 to 15% by weight water, based on the total weight of the granulate.

The sum of the percentages of components a)-e) by weight is always 100%.

The formulation according to the invention may also comprise a mixture of granulates having different compositions and it is also possible for granulates not having a composition according to the invention to be used in admixture.

The granulates in the formulations according to the invention are not encapsulated and have a substantially homogeneous distribution of ingredients.

As the phthalocyanine compound for the granulates there come into consideration phthalocyanine complexes with di-, tri- or tetra-valent metals (complexes having a $d^0$ or $d^{10}$ configuration) as the central atom.

Such complexes are especially water-soluble Zn(II), Fe(II), Ca(II), Mg(II), Na(I), K(I), Al, Si(IV), P(V), Ti(IV), Ge(IV), Cr(VI), Ga(III), Zr(IV), In(III), Sn(IV) and Hf(VI) phthalocyanines, aluminium and zinc phthalocyanines being especially preferred.

The granulate of the formulation according to the invention advantageously comprises at least one phthalocyanine compound of formula $$[Me]_q[PC][Q_1]_r^+A_s^- \quad (1a)$$

or $$[Me]_q[PC][Q_2]_r \quad (1b)$$

wherein

PC is the phthalocyanine ring system;

Me is Zn; Fe(II); Ca; Mg; Na; K; Al—$Z_1$; Si(IV); P(V); Ti(IV); Ge(IV); Cr(VI); Ga(III); Zr(IV); In(III); Sn(IV) or Hf(VI);

$Z_1$ is a halide ion, sulfate ion, nitrate ion, acetate ion or hydroxy ion;

q is 0, 1 or 2;

r is from 1 to 4;

$Q_1$ is a sulfo or carboxy group; or is a radical of formula $$—SO_2X_2—R_6—X_3^+;\ —O—R_6—X_3^+;\ \text{or}\ —(CH_2)_t—Y_1^+;$$

wherein $R_6$ is branched or unbranched $C_1$-$C_8$alkylene; or 1,3- or 1,4-phenylene;

$X_2$ is —NH—; or —N—$C_1$-$C_5$alkyl-; $X_3^+$ is a group of formula

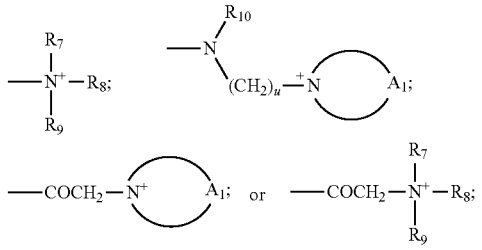

and, in the case where $R_5$=$C_1$-$C_8$alkylene, may also be a group of formula

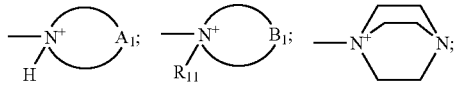

-continued

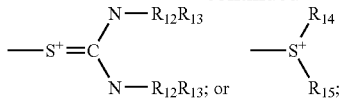

$Y_1^+$ is a group of formula

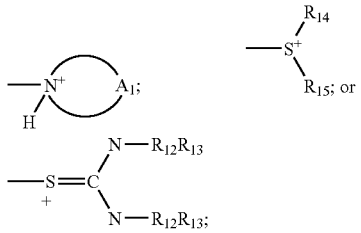

t is 0 or 1;

in which above formulae, $R_7$ and $R_8$ are each independently of the other $C_1$-$C_6$alkyl;

$R_9$ is $C_1$-$C_6$alkyl; $C_5$-$C_7$cycloalkyl; or $NR_{11}R_{12}$;

$R_{10}$ and $R_{11}$ are each independently of the other $C_1$-$C_5$alkyl;

$R_{12}$ and $R_{13}$ are each independently of the other hydrogen or $C_1$-$C_5$alkyl;

$R_{14}$ and $R_{15}$ are each independently of the other unsubstituted or hydroxy-, cyano-, carboxy-, $C_1$-$C_6$alkoxy-carbonyl-, $C_1$-$C_6$alkoxy-, phenyl-, naphthyl- or pyridyl-substituted $C_1$-$C_6$alkyl;

u is from 1 to 6;

$A_1$ is the balance of an aromatic 5- to 7-membered nitrogen heterocycle which may contain one or two further nitrogen atoms as ring members, and $B_1$ is the balance of a saturated 5- to 7-membered nitrogen heterocycle which may contain 1 or 2 further nitrogen, oxygen and/or sulfur atoms as ring members;

$Q_2$ is hydroxy; $C_1$-$C_{22}$alkyl; branched $C_3$-$C_{22}$alkyl; $C_2$-$C_{22}$alkenyl; branched $C_4$-$C_{22}$alkenyl or a mixture thereof; $C_1$-$C_{22}$alkoxy; a sulfo or carboxy radical; a radical of formula

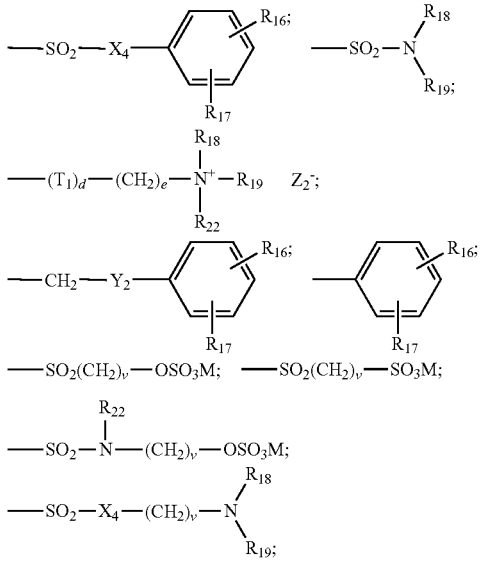

-continued

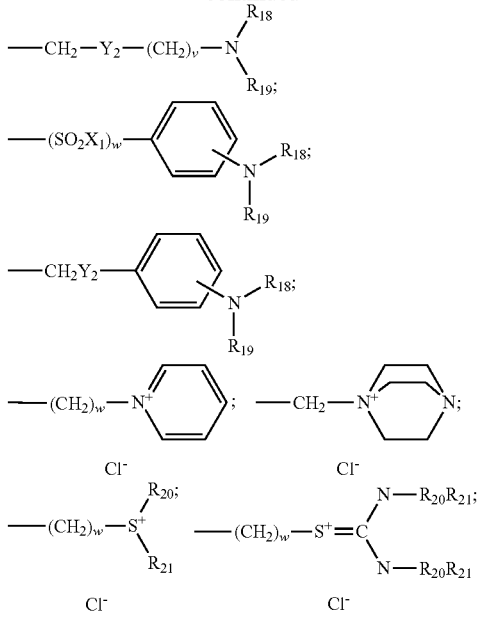

a branched alkoxy radical of formula

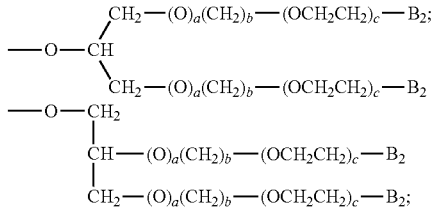

an alkylethyleneoxy unit of formula $-(T_1)_d-(CH_2)_b(OCH_2CH_2)_a—B_3$ or an ester of formula $COOR_{23}$, wherein $B_2$ is hydrogen; hydroxy; $C_1$-$C_{30}$alkyl; $C_1$-$C_{30}$alkoxy; $—CO_2H$; $—CH_2COOH$; $SO_3^-M_1$; $—OSO_3^-M_1$; $—PO_3^{2-}M_1$; $—OPO_3^{2-}M_1$; or a mixture thereof;

$B_3$ is hydrogen; hydroxy; —COOH; $—SO_3^-M_1$; $—OSO_3^-M_1$; or $C_1$-$C_6$alkoxy;

$M_1$ is a water-soluble cation;

$T_1$ is —O—; or —NH—;

$X_1$ and $X_4$ are each independently of the other —O—; —NH—; or —N—$C_1$-$C_5$alkyl;

$R_{16}$ and $R_{17}$ are each independently of the other hydrogen; a sulfo group or a salt thereof; a carboxy group or a salt thereof, or a hydroxy group, at least one of the radicals $R_{16}$ and $R_{17}$ being a sulfo or carboxy group or a salt thereof, $Y_2$ is —O—; —S—; —NH— or —N—$C_1$-$C_5$alkyl;

$R_{18}$ and $R_{19}$ are each independently of the other hydrogen; $C_1$-$C_6$alkyl; hydroxy-$C_1$-$C_6$alkyl; cyano-$C_1$-$C_6$alkyl; sulfo-$C_1$-$C_6$alkyl; carboxy- or halo-$C_1$-$C_6$alkyl; unsubstituted or halo-, $C_1$-$C_4$alkyl-, $C_1$-$C_4$alkoxy-, sulfo- or carboxy-substituted phenyl; or $R_{18}$ and $R_{19}$, together with the nitrogen atom to which they are bonded, are a saturated 5- or 6-membered heterocyclic ring which may additionally contain a further nitrogen or oxygen atom as ring member;

$R_{20}$ and $R_{21}$ are each independently of the other a $C_1$-$C_6$alkyl or aryl-$C_1$-$C_6$alkyl radical;

$R_{22}$ is hydrogen; or unsubstituted or halo-, hydroxy-, cyano-, phenyl-, carboxy-, $C_1$-$C_6$-alkoxy-carbonyl- or $C_1$-$C_6$alkoxy-substituted $C_1$-$C_6$alkyl;

$R_{23}$ is $C_1$-$C_{22}$alkyl; branched $C_4$-$C_{22}$alkyl; $C_1$-$C_{22}$alkenyl or branched $C_4$-$C_{22}$alkenyl; $C_3$-$C_{22}$-glycol; $C_1$-$C_{22}$alkoxy; branched $C_4$-$C_{22}$alkoxy; or a mixture thereof;

M is hydrogen; or an alkali metal ion or ammonium ion, $Z_2^-$ is a chlorine ion, bromine ion, alkylsulfate ion or aralkylsulfate ion;

a is 0 or 1;

b is from 0 to 6;

c is from 0 to 100;

d is 0 or 1;

e is from 0 to 22;

v is an integer from 2 to 12;

w is 0 or 1; and $A^-$ is an organic or inorganic anion, and s in the case of monovalent anions $A^-$ is equal to r and in the case of polyvalent anions is $\leqq$r, it being necessary for $A_s^-$ to balance the positive charge; and when r≠1, the radicals $Q_1$ may be identical or different, and wherein the phthalocyanine ring system may also contain further solubility-imparting groups.

The number of substituents $Q_1$ and $Q_2$ in formula (1a) and in formula (1b), respectively, which substituents may be identical or different, is from 1 to 8 and, as is customary with phthalocyanines, the number need not be a whole number (degree of substitution). If other, non-cationic substituents are also present, the sum of the latter and the cationic substituents is from 1 to 4. The minimum number of substituents that need to be present in the molecule is governed by the water-solubility of the resulting molecule. An adequate solubility is achieved when the amount of phthalocyanine compound that dissolves is sufficient to cause photodynamically catalysed oxidation on the fibres. A solubility as low as 0.01 mg/l may be sufficient, but generally a solubility of from 0.001 to 1 g/l is expedient.

Halogen is fluorine, bromine or, especially, chlorine.

As groups

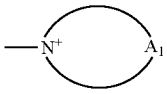

there come into consideration especially:

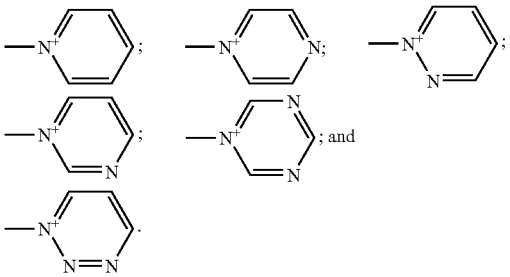

Preference is given to the group

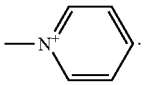

As heterocyclic rings in the group

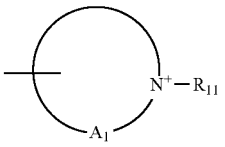

there likewise come into consideration the groups mentioned above, but with the bond to the remaining substituents being effected by way of a carbon atom.

In all substituents, phenyl, naphthyl and aromatic hetero rings may be substituted by one or two further radicals, for example by $C_1$-$C_6$alkyl, $C_1$-$C_6$alkoxy, halogen, carboxy, $C_1$-$C_6$alkoxy-carbonyl, hydroxy, amino, cyano, sulfo, sulfonamido etc.

Preference is given to a substituent from the group $C_1$-$C_6$alkyl, $C_1$-$C_6$alkoxy, halogen, carboxy, $C_1$-$C_6$alkoxy-carbonyl and hydroxy.

As the group

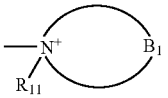

there come into consideration especially:

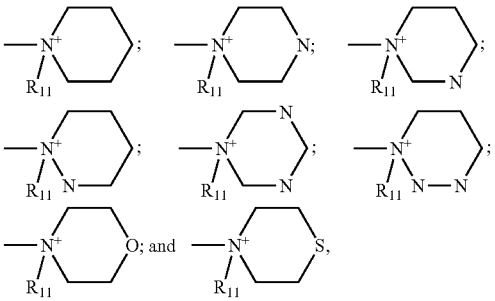

$R_{11}$ being as defined above, especially $CH_3$ or $CH_2CH_3$.

All above-mentioned nitrogen heterocycles may, in addition, be substituted by alkyl groups, either at a carbon atom or at a further nitrogen atom located in the ring, with preference being given to a methyl group as the alkyl group.

$A_s^-$ in formula (1a) denotes, as counterion to the positive charge of the remainder of the molecule, any desired anion. It is generally introduced in the process of manufacture (quaternisation), in which case it is preferably a halogen ion, an alkylsulfate ion or an arylsulfate ion. Among the arylsulfate ions mention should be made of the phenylsulfonate, p-tolysulfonate and p-chlorophenylsulfonate ions. It is also possible, however, for any other anion to function as the anion, since the anions can readily be interchanged in known manner; accordingly, $A_s^-$ may also be a sulfate, sulfite, carbonate, phosphate, nitrate, acetate, oxalate, citrate or lactate ion or another anion of an organic carboxylic acid. In the case of monovalent anions, the index s is equal to r. In the case of polyvalent anions, s assumes a value $\geqq$r but must be such, depending on the conditions, that it exactly balances the positive charge of the remainder of the molecule.

$C_1$-$C_6$Alkyl and $C_1$-$C_6$alkoxy are straight-chain or branched alkyl and alkoxy radicals, respectively, for example methyl, ethyl, n-propyl, isopropyl, n-butyl, sec-butyl, tert-butyl, amyl, isoamyl, tert-amyl or hexyl, and methoxy, ethoxy, n-propoxy, isopropoxy, n-butoxy, sec-butoxy, tert-butoxy, amyloxy, isoamyloxy, tert-amyloxy or hexyloxy, respectively.

$C_2$-$C_{22}$Alkenyl denotes, for example, allyl, methallyl, isopropenyl, 2-butenyl, 3-butenyl, isobutenyl, n-penta-2,4-dienyl, 3-methyl-but-2-enyl, n-oct-2-enyl, n-dodec-2-enyl, isododecenyl, n-dodec-2-enyl or n-octadec-4-enyl.

Preferred phthalocyanine compounds of formula (1a) of the granulates correspond to formula

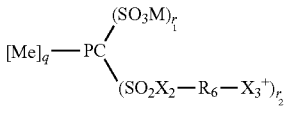

(2a)

wherein

Me, q, PC, $X_2$, $X_3$ and $R_6$ are as defined for formula (1a),

M is hydrogen; or an alkali metal ion, ammonium ion or amine salt ion; and the sum of the numbers $r_1$ and $r_2$ is from 1 to 4, and $A_s^-$ exactly balances the positive charge of the remainder of the molecule, and especially to formula $$[Me]_q—[Pc]—[SO_2NHR_6'—X_3'^+A'^-]_r, \quad (3)$$

wherein

Me, q and PC are as defined for formula (1a), $R_6'$ is $C_2$-$C_6$alkylene;

r is a number from 1 to 4;

$X_3'$ is a group of formula

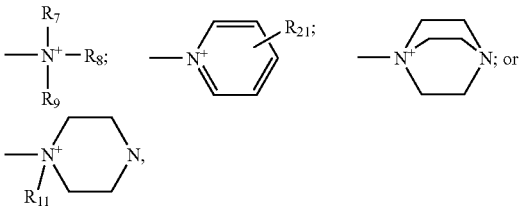

wherein $R_7$ and $R_8$ are each independently of the other unsubstituted or hydroxy-, cyano-, halo- or phenyl-substituted $C_1$-$C_4$alkyl;

$R_9$ is $R_7$; cyclohexyl or amino;

$R_{11}$ is $C_1$-$C_4$alkyl;

$R_{21}$, is $C_1$-$C_4$alkyl; $C_1$-$C_4$alkoxy; halogen; carboxy; $C_1$-$C_4$alkoxy-carbonyl or hydroxy; and $A'^-$ is a halide ion, alkylsulfate ion or arylsulfate ion;

it being possible for the radicals $—SO_2NHR'_6—X_3'^+A'^-$ to be identical or different.

Further phthalocyanine compounds that can be used in the granulate of the formulations according to the invention correspond to formula $$[Me]_q[PC][SO_3—Y_3']_r \quad (4)$$

wherein

PC is the phthalocyanine ring system;

Me is Zn; Fe(II); Ca; Mg; Na; K; Al—$Z_1$; Si(IV); P(V); Ti(IV); Ge(IV); Cr(VI); Ga(III); Zr(IV); In(III); Sn(IV) or Hf(VI);

$Z_1$ is a halide ion, sulfate ion, nitrate ion, acetate ion or hydroxy ion;

q is 0; 1; or 2;

$Y_3'$ is hydrogen; or an alkali metal ion or ammonium ion; and r is any number from 1 to 4.

Of those, very special preference is given to phthalocyanine compounds of formula (4) wherein Me is Zn or Al—$Z_1$; and $Z_1$ is a halide ion, sulfate ion, nitrate ion, acetate ion or hydroxy ion.

Further phthalocyanine compounds of interest that can be used in the granulate of the formulations according to the invention correspond to formula

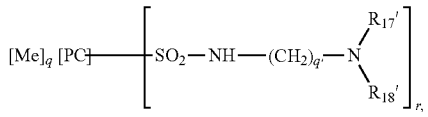

(5)

wherein

PC, Me and q are as defined for formula (4);

$R_{17}'$ and $R_{18}'$ are each independently of the other hydrogen; phenyl; sulfophenyl; carboxyphenyl; $C_1$-$C_6$alkyl; hydroxy-$C_1$-$C_6$alkyl; cyano-$C_1$-$C_6$alkyl; sulfo-$C_1$-$C_6$alkyl; carboxy-$C_1$-$C_6$alkyl or halo-$C_1$-$C_6$alkyl or, together with the nitrogen atom, form a morpholine ring;

q' is an integer from 2 to 6; and r is a number from 1 to 4;

it being possible, when r>1, for the radicals

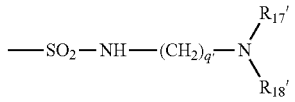

present in the molecule to be identical or different.

Further phthalocyanine compounds of interest that can be used in the granulate of the formulations according to the invention correspond to formula

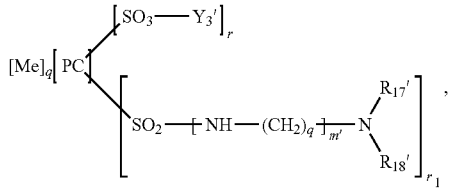

(6)

wherein

PC, Me and q are as defined for formula (4), $Y'_3$ is hydrogen; or an alkali metal ion or ammonium ion, q' is an integer from 2 to 6;

$R_{17}'$ and $R_{18}'$ are each independently of the other hydrogen; phenyl; sulfophenyl; carboxyphenyl; $C_1$-$C_6$alkyl; hydroxy-$C_1$-$C_6$alkyl; cyano-$C_1$-$C_6$alkyl; sulfo-$C_1$-$C_6$alkyl; carboxy-$C_1$-$C_6$alkyl or halo-$C_1$-$C_6$alkyl or, together with the nitrogen atom, form a morpholine ring, m' is 0 or 1; and r and $r_1$ are each independently of the other any number from 0.5 to 3.5, the sum $r+r_1$ being a minimum of 1 and a maximum of 4.

Where the central atom Me in the phthalocyanine ring is Si(IV), the phthalocyanines used in the granulate of the formulations according to the invention may also contain, in addition to the substituents on the phenyl nucleus of the phthalocyanine ring, axial substituents ($=R_{24}$).

Such phthalocyanines correspond, for example, to formula (7)

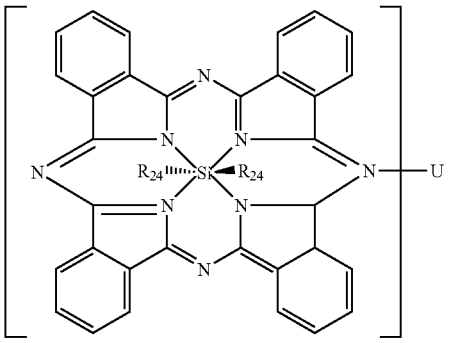

wherein $R_{24}$ is hydroxy; $C_1$-$C_{22}$alkyl; branched $C_4$-$C_{22}$alkyl; $C_1$-$C_{22}$alkenyl; branched $C_4$-$C_{22}$alkenyl or a mixture thereof; $C_1$-$C_{22}$alkoxy; a sulfo or carboxy radical; a radical of formula

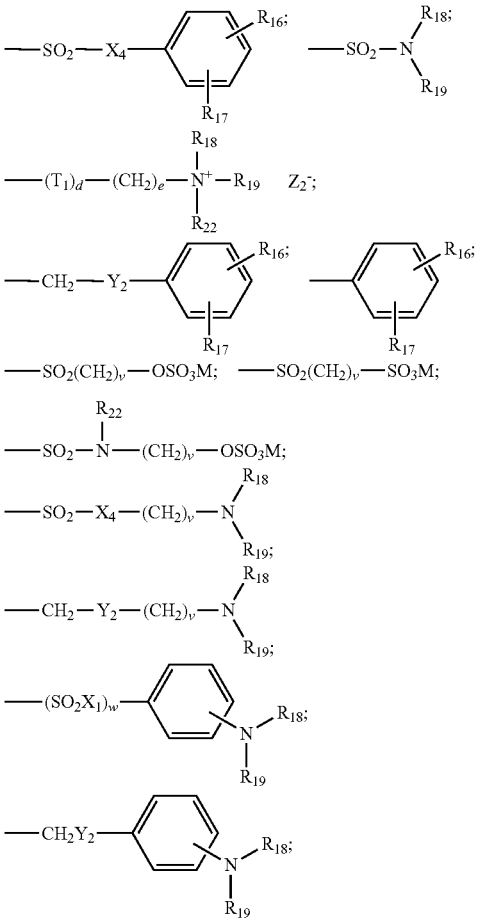

-continued

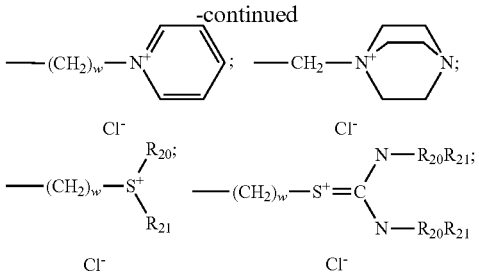

a branched alkoxy radical of formula

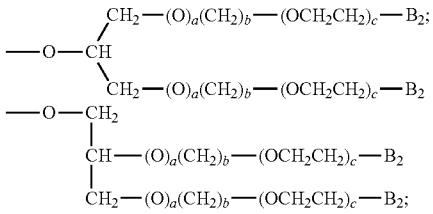

an alkylethyleneoxy unit of formula $-(T_1)_d-(CH_2)_b(OCH_2CH_2)_a—B_3$ or an ester of formula $COOR_{23}$ and U is $[Q_1]_r^+A_s^-$; or $Q_2$.

$R_{16}$, $R_{17}$, $R_{18}$, $R_{19}$, $R_{20}$, $R_{21}$, $R_{22}$, $R_{23}$, $B_2$, $B_3$, M, $Q_1$, $Q_2$, $A_s$, $T_1$, $X_1$, $X_4$, $Y_2$, $Z_2^-$, a, b, c, d, e, r, v and w therein being as defined for formulae (1a) and (1b).

Especially preferred phthalocyanine compounds are such compounds as are commercially available and used in washing agent compositions. Usually, the anionic phthalocyanine compounds are in the form of alkali metal salts, especially sodium salts.

The granulates in the formulations according to the invention contain from 2 to 50% by weight, preferably from 4 to 30% by weight, especially from 5 to 20% by weight, of at least one phthalocyanine compound, based on the total weight of the granulate.

The granulates in the formulations according to the invention contain from 10 to 60% by weight, preferably from 12 to 60% by weight, especially from 12 to 55% by weight, of at least one anionic dispersing agent and/or at least one water-soluble organic polymer, based on the total weight of the granulate.

Such anionic dispersing agents and also the water-soluble organic polymers, which may also have dispersing properties, are described hereinbelow.

Anionic Dispersing Agents:

The anionic dispersing agents used are, for example, the commercially available water-soluble anionic dispersing agents for dyes, pigments etc.

The following products, especially, come into consideration: condensation products of aromatic sulfonic acids and formaldehyde, condensation products of aromatic sulfonic acids with unsubstituted or chlorinated biphenyls or biphenyl oxides and optionally formaldehyde, (mono-/di-)alkylnaphthalenesulfonates, sodium salts of polymerised organic sulfonic acids, sodium salts of polymerised alkylnaphthalenesulfonic acids, sodium salts of polymerised alkylbenzenesulfonic acids, alkylarylsulfonates, sodium salts of alkyl polyglycol ether sulfates, polyalkylated polynuclear arylsulfonates, methylene-linked condensation products of arylsulfonic acids and hydroxyarylsulfonic acids, sodium salts of dialkylsulfosuccinic acids, sodium salts of alkyl diglycol ether sulfates, sodium salts of polynaphthalene-methanesulfonates, ligno- or oxyligno-sulfonates or heterocyclic polysulfonic acids.

Especially suitable anionic dispersing agents are condensation products of naphthalene-sulfonic acids with formaldehyde sodium salts of polymerised organic sulfonic acids, (mono-/di-)alkylnaphthalenesulfonates, polyalkylated polynuclear arylsulfonates, sodium salts of polymerised alkylbenzenesulfonic acid, lignosulfonates, oxylignosulfonates and condensation products of naphthalenesulfonic acid with a polychloromethylbiphenyl.

Instead of or in addition to the dispersing agent or agents, the granulates according to the invention may comprise a water-soluble organic polymer, which may also have dispersing properties. Such polymers may be used singly or as mixtures of two or more polymers. As water-soluble polymers (which may, but need not, have film-forming properties), there come into consideration, for example, gelatins, polyacrylates, polymethacrylates, copolymers of ethyl acrylate, methyl methacrylate and methacrylic acid (ammonium salt), polyvinylpyrrolidones, vinylpyrrolidones, vinyl acetates, copolymers of vinylpyrrolidone with long-chain olefins, poly (vinylpyrrolidone/dimethylaminoethyl methacrylates), copolymers of vinylpyrrolidone/dimethylaminopropyl methacrylamides, copolymers of vinyl-pyrrolidone/dimethylaminopropyl acrylamides, quaternised copolymers of vinylpyrrolidones and dimethylaminoethyl methacrylates, terpolymers of vinylcaprolactam/vinyl-pyrrolidone/dimethylaminoethyl methacrylates, copolymers of vinylpyrrolidone and methacrylamidopropyltrimethylammonium chloride, terpolymers of caprolactam/vinyl-pyrrolidone/dimethylaminoethyl methacrylates, copolymers of styrene and acrylic acid, polycarboxylic acids, polyacrylamides, carboxymethyl cellulose, hydroxymethyl cellulose, polyvinyl alcohols, hydrolysed and non-hydrolysed polyvinyl acetate, copolymers of maleic acid with unsaturated hydrocarbons and also mixed polymerisation products of the mentioned polymers. Further suitable substances are polyethylene glycol (MW=4000-20 000), copolymers of ethylene oxide with propylene oxide (MW>3500), condensation products (block polymerisation products) of alkylene oxide, especially propylene oxide, copolymers of vinylpyrrolidone with vinyl acetate, ethylene oxide-propylene oxide addition products with diamines, especially ethylenediamine, polystyrenesulfonic acid, polyethylene-sulfonic acid, copolymers of acrylic acid with sulfonated styrenes, gum arabic, hydroxypropyl methylcellulose, sodium carboxymethyl cellulose, hydroxypropyl methylcellulose phthalate, maltodextrin, starch, sucrose, lactose, enzymatically modified and subsequently hydrated sugars, as are obtainable under the name "Isomalt", cane sugar, polyaspartic acid and tragacanth.

Among those water-soluble organic polymers, special preference is given to carboxymethyl cellulose, polyacrylamides, polyvinyl alcohols, polyvinylpyrrolidones, gelatins, hydrolysed polyvinyl acetates, copolymers of vinylpyrrolidone and vinyl acetate, maltodextrins, polyaspartic acid and also polyacrylates and polymethacrylates.

The granulates in the formulations according to the invention contain from 15 to 75% by weight, preferably from 20 to 75% by weight, especially from 25 to 70% by weight, of at least one inorganic salt and/or at least one low-molecular-weight organic acid and/or a salt thereof.

The mentioned components are described in detail hereinbelow:

Inorganic Salts:

For use as inorganic salts there come into consideration carbonates, hydrogen carbonates, phosphates, polyphosphates, sulfates, silicates, sulfites, borates, halides and pyrophosphates, preferably in the form of alkali metal salts. Preference is given to water-soluble salts such as, for example, alkali metal chlorides, alkali phosphates, alkali carbonates, alkali polyphosphates and alkali sulfates and water-soluble salts used in washing agent and/or washing agent additive formulations.

Low-Molecular-Weight Organic Acids and Salts Thereof:

There come into consideration as low-molecular-weight acids, for example, mono- or poly-carboxylic acids. Of special interest are aliphatic carboxylic acids, especially those having a total number of from 1 to 12 carbon atoms. Preferred acids are aliphatic $C_1$-$C_{12}$-mono- or -poly-carboxylic acids, the monocarboxylic acids being especially those having at least 3 carbon atoms in total. As substituents of the carboxylic acids there come into consideration, for example, hydroxy and amino, especially hydroxy. Special preference is given to aliphatic $C_2$-$C_{12}$polycarboxylic acids, especially aliphatic $C_2$-$C_6$polycarboxylic acids. Very special preference is given to hydroxy-substituted aliphatic $C_2$-$C_6$polycarboxylic acids. These compounds may be used in the form of the free acid or a salt, especially an alkali salt.

There may also be used aminopolycarboxylates (e.g. sodium ethylenediaminetetraacetate), phytates, phosphonates, aminopolyphosphonates (e.g. sodium ethylenediaminetetra-phosphonate), aminoalkylenepoly(alkylenephosphonates), polyphosphonates, polycarboxylates or water-soluble polysiloxanes.

As examples of low-molecular-weight organic acids and salts thereof there may be mentioned oxalic acid, tartaric acid, acetic acid, propionic acid, succinic acid, maleic acid, citric acid, formic acid, gluconic acid, p-toluenesulfonic acid, terephthalic acid, benzoic acid, phthalic acid, acrylic acid and polyacrylic acid.

The granulates in the formulations according to the invention may comprise further additives, for example wetting agents, disintegrants such as, for example, powdered or fibrous cellulose, microcrystalline cellulose, fillers such as, for example, dextrin, water-insoluble or water-soluble dyes or pigments, and also dissolution accelerators and optical brighteners. Aluminium silicates such as zeolites, and also compounds such as talc, kaolin, $TiO_2$, $SiO_2$ or magnesium trisilicate may also be used in small amounts. Such additives are present in an amount of from 0 to 10% by weight, preferably from 0 to 5% by weight, based on the total weight of the granulates.

As especially preferred additives, special emphasis is to be given to powdered or fibrous weight, preferably from 0 to 5% by weight, based on the total weight of the granulates.

The granulates in the formulations according to the invention may contain from 3 to 15% water by weight, based on the total weight of the granulate.

A preferred formulation according to the invention comprises at least one granulate consisting of a) from 4 to 30% by weight of at least one water-soluble phthalocyanine compound,
b) from 12 to 60% by weight of at least one anionic dispersing agent and/or at least one water-soluble organic polymer,
c) from 20 to 75% by weight of at least one inorganic salt and/or at least one low-molecular-weight organic acid or a salt thereof,
d) from 0 to 5% by weight of at least one further additive, and
e) from 3 to 15% by weight water, based on the total weight of the granulate.

A formulation according to the invention to which greater preference is given comprises at least one granulate consisting of a) from 5 to 20% by weight of at least one water-soluble phthalocyanine compound, b) from 12 to 55% by weight of at least one anionic dispersing agent and/or at least one water-soluble organic polymer, c) from 25 to 70% by weight of at least one inorganic salt and/or at least one low-molecular-weight organic acid or a salt thereof, d) from 0 to 5% by weight of at least one zeolite compound and, where appropriate, further additives, and e) from 3 to 15% by weight water, based on the total weight of the granulate.

A likewise preferred formulation according to the invention comprises at least one granulate consisting of a) from 2 to 50% by weight of at least one water-soluble phthalocyanine compound of formula (2a), (3), (4), (5), (6) and/or (7) defined above, b) from 10 to 60% by weight of at least one anionic dispersing agent from the group consisting of condensation products of naphthalene-sulfonic acid with formaldehyde; sodium salts of polymerised organic sulfonic acids; (mono-/di-)alkyl-naphthalenesulfonates; polyalkylated polynuclear aryl-sulfonates; sodium salts of polymerised alkylbenzene-sulfonic acids; lignosulfonates; oxylignosulfonates and condensation products of naphthalenesulfonic acid with a polychloromethylbiphenyl;

and/or at least one water-soluble organic polymer from the group consisting of carboxymethyl cellulose; polyacrylamides; polyvinyl alcohols; polyvinylpyrrolidones; gelatins; hydrolysed polyvinyl acetates; copolymers of vinylpyrrolidone and vinyl acetate; maltodextrins; polyaspartic acid; polyacrylates and polymethacrylates, and c) from 15 to 75% by weight of at least one inorganic salt and/or at least one low-molecular-weight organic acid or a salt thereof from the group consisting of carbonates; hydrogen carbonates; phosphates; polyphosphates; sulfates; silicates; sulfites; borates; halides; pyrophosphates; aliphatic carboxylic acids having a total number of from 1 to 12 carbon atoms, which are unsubstituted or substituted by hydroxy and/or by amino; aminopolycarboxylates; phytates; phosphonates; aminopolyphosphonates; aminoalkylenepoly(alkylenephosphonates); polyphosphonates; polycarboxylates; water-soluble polysiloxanes; and water-soluble salts that are used in washing agent and/or washing agent additive formulations, and d) from 0 to 10% by weight of at least one further additive from the group consisting of wetting agents; disintegrants; fillers; water-insoluble or water-soluble dyes or pigments; dissolution accelerators; optical brighteners; aluminium silicates; talc; kaolin; $TiO_2$, $SiO_2$; and magnesium trisilicate, and e) from 3 to 15% by weight water, based on the total weight of the granulate.

The granulates in the formulations according to the invention preferably have an average particle size of <500 μm. Greater preference is given to the particle size of the granulates being from 40 to 400 μm.

The formulations according to the invention can, depending on the composition of the granulate according to the invention, be used as such, as an additive in other formulations or in combination with another formulation. Preference is given to use of the formulations according to the invention in a washing agent composition or in a washing agent additive, for example, a pre- and/or after-treatment agent, stain-removing salt, washing-power enhancer, fabric conditioner, bleaching agent or UV-protection enhancer.

The formulations according to the invention are used especially as an additive in a washing agent formulation. Such a washing agent formulation may be in solid, liquid, gel-like or paste-like form, for example in the form of a liquid, non-aqueous washing agent composition containing not more than 5% by weight, preferably from 0 to 1% by weight, water and based on a suspension of a builder substance in a non-ionic surfactant, for example as described in GB-A-2 158 454.

The formulations according to the invention may also be in the form of powders or (super-)compact powders, in the form of single- or multi-layer tablets (tabs), in the form of washing agent bars, washing agent blocks, washing agent sheets, washing agent pastes or washing agent gels, or in the form of powders, pastes, gels or liquids used in capsules or in pouches (sachets).

However, the washing agent compositions are preferably in the form of non-aqueous formulations, powders, tabs or granules.

The present invention accordingly relates also to washing agent formulations containing I) from 5 to 70% A) of at least one anionic surfactant and/or B) at least one non-ionic surfactant, based on the total weight of the washing agent formulation, II) from 5 to 60% C) of at least one builder substance, based on the total weight of the washing agent formulation, III) from 0 to 30% D) of at least one peroxide and, optionally, at least one activator, based on the total weight of the washing agent formulation, and IV) from 0.001 to 1% E) of at least one granulate which contains a) from 2 to 50% by weight of at least one water-soluble phthalocyanine compound, based on the total weight of the granulate, b) from 10 to 60% by weight of at least one anionic dispersing agent and/or at least one, water-soluble organic polymer, based on the total weight of the granulate, c) from 15 to 75% by weight of at least one inorganic salt and/or at least one low-molecular-weight organic acid or a salt thereof, based on the total weight of the granulate, d) from 0 to 10% by weight of at least one further additive, based on the total weight e) from 3 to 15% by weight water, based on the total weight of the granulate, V) from 0 to 60% F) of at least one further additive, and VI) from 0 to 5% G) water.

The sum of the percentages by weight of components I)-VI) in a formulation is always 100%.

All the preferences mentioned hereinbefore apply to the granulate E).

The anionic surfactant A) may be, for example, a sulfate, sulfonate or carboxylate surfactant or a mixture of those surfactants. Preferred sulfates are those having from 12 to 22 carbon atoms in the alkyl radical, where appropriate in combination with alkyl ethoxysulfates having from 10 to 20 carbon atoms in the alkyl radical. Preferred sulfonates are, for example, alkylbenzenesulfonates having from 9 to 15 carbon atoms in the alkyl radical and/or alkylnaphthalenesulfonates having from 6 to 16 carbon atoms in the alkyl radical. The cation in the anionic surfactant is preferably an alkali metal cation, especially sodium. Preferred carboxylates are alkali metal sarcosinates of the formula R—CO—N($R^1$)—

$CH_2COOM^1$, wherein R is alkyl or alkenyl having from 8 to 18 carbon atoms in the alkyl or alkenyl radical, $R^1$ is $C_1$-$C_4$alkyl and $M^1$ is an alkali metal.

The non-ionic surfactant B) may be, for example, a condensation product of from 3 to 8 mols of ethylene oxide with 1 mol of primary alcohol containing from 9 to 15 carbon atoms.

There come into consideration as builder substance C), for example, alkali metal phosphates, especially tripolyphosphates, carbonates or hydrogen carbonates, especially the sodium salts, silicates, aluminium silicates, polycarboxylates, polycarboxylic acids, organic phosphonates, aminoalkylenepoly(alkylenephosphonates) or mixtures of those compounds. Especially suitable silicates are sodium salts of crystalline silicates having layered structures of the formula $NaHSi_tO_{2t+1}.pH_2O$ or $Na_2Si_tO_{2t+1}.pH_2O$, wherein t is a number from 1.9 to 4 and p is a number from 0 to 20. Among the aluminium silicates, preference is given to those obtainable commercially under the names zeolite A, B, X and HS, and also to mixtures comprising two or more of those components.

Among the polycarboxylates, preference is given to polyhydroxycarboxylates, especially citrates, and acrylates and also copolymers thereof with maleic anhydride. Preferred polycarboxylic acids are nitrilotriacetic acid, ethylenediaminetetraacetic acid and ethylenediamine disuccinate either in racemic form or in the enantiomerically pure S,S form. Phosphonates and aminoalkylenepoly(alkylenephosphonates) that are especially suitable are alkali metal salts of 1-hydroxyethane-1,1-diphosphonic acid, nitrilotris(methylenephosphonic acid), ethylenediaminetetramethylenephosphonic acid and diethylenetriamine-pentamethylenephosphonic acid.

There come into consideration as the peroxide component D), for example, the organic and inorganic peroxides known in the literature and available commercially that bleach textile materials at conventional washing temperatures, for example at from 10 to 95° C. The organic peroxides are, for example, mono- or poly-peroxides, especially organic peracids or salts thereof, such as phthalimidoperoxycaproic acid, peroxybenzoic acid, diperoxydodecanoic diacid, diperoxynonanoic diacid, diperoxydecanoic diacid, diperoxyphthalic acid or salts thereof. Preferably, however, inorganic peroxides are used, such as, for example, persulfates, perborates, percarbonates and/or persilicates. It will be understood that mixtures of inorganic and/or organic peroxides can also be used. The peroxides may be in a variety of crystalline forms and have different water contents, and they may also be used together with other inorganic or organic compounds in order to improve their storage stability. The peroxides are added to the washing agent composition preferably by mixing the components, for example using a screw metering system and/or a fluidised bed mixer.

The washing agent compositions may comprise, in addition to the combination according to the invention, one or more optical brighteners, for example from the class bis-triazinylaminostilbenedisulfonic acid, bis-triazolylstilbenedisulfonic acid, bis-styrylbiphenyl and bis-benzofuranylbiphenyl, a bis-benzoxalyl derivative, bis-benzimidazolyl derivative, coumarin derivative or a pyrazoline derivative.

The washing agent compositions may also comprise suspending agents for dirt, e.g. sodium carboxymethyl cellulose, pH regulators, e.g. alkali metal or alkaline earth metal silicates, foam regulators, e.g. soap, salts for regulating the spray-drying and the granulating properties, e.g. sodium sulfate, fragrances and, optionally, antistatic agents and fabric conditioners, enzymes, such as amylase, bleaching agents, pigments and/or toning agents. It will be understood that such constituents must be stable towards the bleaching agent used.

Further preferred additives to the washing agent compositions according to the invention are polymers which, during the washing of textiles, prevent staining caused by dyes in the washing liquor which have been released from the textiles under the washing conditions. Such polymers are preferable polyvinylpyrrolidones which, where appropriate, have been modified by the incorporation of anionic or cationic substituents, especially those polyvinylpyrrolidones having a molecular weight in the range from 5000 to 60 000, more especially from 10 000 to 50 000. Such polymers are preferably used in an amount of from 0.05 to 5% by weight, especially from 0.2 to 1.7% by weight, based on the total weight of the washing agent composition.

In addition, the washing agent compositions according to the invention may also comprise so-called perborate activators, such as, for example, TAED or TAGU. Preference is given to TAED, which is preferably used in an amount of from 0.05 to 5% by weight, especially from 0.2 to 1.7% by weight, based on the total weight of the washing agent composition.

The percentages of components I) to VI) in the washing agent formulations hereinbelow are in all cases based on the total weight of the washing agent formulation.

A preferred washing agent formulation according to the invention consists of

I) from 5 to 70% A) of at least one anionic surfactant from the group consisting of alkylbenzenesulfonates having from 9 to 15 carbon atoms in the alkyl radical; alkyl-naphthalenesulfonates having from 6 to 16 carbon atoms in the alkyl radical; and alkali metal sarcosinates of the formula $R—CO—N(R_1)—CH_2COOM_1$,
   wherein R is alkyl or alkenyl having from 8 to 18 carbon atoms in the alkyl or alkenyl radical,
   $R_1$ is $C_1$-$C_4$alkyl and
   $M_1$ is an alkali metal and/or
   B) at least one non-ionic surfactant from the group consisting of condensation products of from 3 to 8 mols of ethylene oxide with 1 mol of primary alcohol containing from 9 to 15 carbon atoms, II) from 5 to 60% C) of a builder substance from the group consisting of alkali metal phosphates; carbonates; hydrogen carbonates; silicates; aluminium silicates; polycarboxylates; poly-carboxylic acids; organic phosphonates and amino-alkylenepoly(alkylenephosphonates), and III) from 0 to 30% D) of a peroxide from the group consisting of organic mono- or poly-peroxides; organic peracids and salts thereof; persulfates; perborates; percarbonates and persilicates, IV) from 0.001 to 1% E) of a granulate which contains
   a) from 2 to 50% by weight of at least one water-soluble phthalocyanine compound of formula (2a), (3), (4), (5), (6) and/or (7) defined above,
   b) from 10 to 60% by weight of at least one anionic dispersing agent from the group consisting of condensation products of naphthalene-sulfonic acid with formaldehyde; sodium salts of polymerised organic sulfonic acids; (mono-/di-)alkylnaphthalenesulfonates; polyalkylated polynuclear arylsulfonates; sodium salts of polymerised alkylbenzenesulfonic acids; lignosulfonates; oxylignosulfonates and condensation products of naphthalenesulfonic acid with a polychloromethylbiphenyl;
   and/or at least one water-soluble organic polymer from the group consisting of carboxymethyl cellulose; polyacrylamides; polyvinyl alcohols; polyvinylpyrrolidones; gelatins; hydrolysed polyvinyl acetates;

copolymers of vinylpyrrolidone and vinyl acetate; maltodextrins; polyaspartic acid; polyacrylates and polymethacrylates, and c) from 15 to 75% by weight of at least one inorganic salt and/or at least one low-molecular-weight organic acid or a salt thereof from the group consisting of carbonates; hydrogen carbonates; phosphates; polyphosphates; sulfates; silicates; sulfites; borates; halides; pyrophosphates; aliphatic carboxylic acids having a total number of from 1 to 12 carbon atoms, which are unsubstituted or substituted by hydroxy and/or by amino; aminopolycarboxylates; phytates; phosphonates; aminopolyphosphonates; aminoalkylenepoly-(alkylenephosphonates); polyphosphonates; polycarboxylates; water-soluble polysiloxanes; and water-soluble salts used in washing agent and/or washing agent additive formulations, and d) from 0 to 10% by weight of at least one further additive from the group consisting of wetting agents; disintegrants; fillers; water-insoluble or water-soluble dyes or pigments; dissolution accelerators; optical brighteners; aluminium silicates; talc; kaolin; $TiO_2$, $SiO_2$; and magnesium trisilicate, and e) from 3 to 15% by weight water, based on the total weight of the granulate, V) from 0 to 60% F) of further additives from the group consisting of optical brighteners; suspending agents for dirt; pH regulators; foam regulators; salts for regulating the spray-drying and granulating properties; fragrances; antistatic agents; fabric conditioners; enzymes; bleaching agents; pigments; toning agents; polymers which, during the washing of textiles, prevent staining caused by dyes in the washing liquor which have been released from the textiles under the washing conditions; and perborate activators, and VI) from 0 to 5% G) water.

The granulates E) are prepared, for example, in the following manner:

Firstly, an aqueous solution of the phthalocyanine compound is prepared, to which there is added at least one dispersing agent and/or at least one polymer and at least one inorganic salt and/or at least one low-molecular-weight organic acid or a salt thereof and, where appropriate, further additives; stirring is carried out, where appropriate with heating, until a homogeneous solution (or a dilute suspension if water-insoluble additives are used) is obtained. The solids content of the solution obtained should preferably be at least 15% by weight, especially from 20 to 45% by weight, based on the total weight of the mixture. The viscosity of the solution is preferably below 600 mPas. The phthalocyanine is preferably present in the slurry in the dissolved state.

The aqueous solution (or suspension) of the phthalocyanine compound is then subjected to a drying step in which all water, with the exception of a residual amount, is removed, solid particles (granules) simultaneously being formed. Known methods are suitable for producing the granulates from the aqueous solution. In principle, both continuous methods and drying and fluidised bed granulation processes.

Especially suitable are spray-drying processes in which the active ingredient solution is sprayed into a chamber with circulating hot air. The atomisation of the solution is carried out using single or binary nozzles or is brought about by the spinning effect of a rapidly rotating disc. In order to increase the particle size, the spray-drying process may be combined with additional agglomeration of the liquid particles with solid nuclei in a fluidised bed that forms an integral part of the chamber (so-called fluidised spray). The fine particles (<100 μm) obtained by a conventional spray-drying process may, if necessary after being separated from the exhaust gas flow, be fed as nuclei, without being further treated, directly into the spray cone of the atomiser of the spray-dryer, for the purpose of agglomeration with the liquid droplets of the active ingredient. During the granulation step, the water can be rapidly removed from the solutions comprising phthalocyanine compound, dispersing agent and/or organic polymer, salt and, where appropriate, further additives, and it is expressly intended that agglomeration of the droplets forming in the spray cone, i.e. the agglomeration of droplets with solid particles, will take place. Preference is given to the use of agglomeration processes to produce the granulates according to the invention because such processes usually yield a higher bulk weight so that the granulates have better compatibility with washing agent formulations.

A further embodiment of the present invention comprises using, for preparation of the granulates, phthalocyanine solutions that have been purified by membrane separation procedures.

If necessary the granules formed in the spray-dryer are removed in a continuous process, for example by a sieving operation. The fines and the oversize particles are either recycled directly to the process (without being redissolved) or are dissolved in the liquid active ingredient formulation and subsequently granulated again.

The residual water content of the granulates E) may be from 3 to 15% by weight.

The granulates are resistant to abrasion, low in dust, free-flowing and can be readily metered. They are distinguished especially by very rapid solubility in water.

The granulates E) preferably have a density in the range from 500 to 900 g/l, dissolve rapidly in water and do not float on the surface of the washing agent solution. They may be added in the desired concentration of the phthalocyanine compound directly to the washing agent formulation.

The content of granulates E) in accordance with the invention in the formulations according to the invention is from to 0.001 to 1% by weight, preferably from 0.001 to 0.05% by weight and very especially from 0.005 to 0.03% by weight.

The washing agent formulation according to the invention can be prepared in a generally known manner.

A formulation in powder form can be prepared, for example, by first preparing an initial powder by spray-drying an aqueous slurry comprising all of the afore-mentioned components except for components D) and E) and then adding the dry components D) and E) and mixing all of them together. It is also possible to start from an aqueous slurry which, although comprising components A) and C), does not comprise component B) or comprises only a portion of component B). The slurry is spray-dried; component E) is then mixed with component B) and added; and then component D) is mixed in dry. The components are preferably mixed with one another in such amounts that a solid compact washing agent composition in granule form is obtained, having a specific weight of at least 500 g/l.

In another preferred embodiment, the production of the washing agent composition is carried out in three steps. In the first step a mixture of anionic surfactant (and, where appropriate, a small amount of non-ionic surfactant) and builder substance is prepared. In the second step that mixture is sprayed with the major portion of the non-ionic surfactant and then, in the third step, peroxide and, where appropriate, catalyst, and the granulate according to the invention are added. That method is usually carried out in a fluidised bed. In a further preferred embodiment, the individual steps are not carried out completely separately, so that there is a certain amount of overlap between them. Such a method is usually carried out in an extruder, in order to obtain granulates in the form of "megapearls".

As an alternative thereto, the granulates according to the invention can, for the purpose of admixture with a washing agent in a post-dosing step, be mixed with other washing agent components such as phosphates, zeolites, brighteners or enzymes.

A mixture of that kind for post-dosing of the granulates is distinguished by a homogeneous distribution of the granulates according to the invention in the mixture and can consist of, for example, from 5 to 50% granulates and from 95 to 50% sodium tripolyphosphate. Where the dark appearance of the granulate in the washing agent composition is to be suppressed, this can be achieved, for example, by embedding the granules in droplets of a whitish meltable substance ("water-soluble wax") or, preferably, by encapsulating the granules in a melt consisting of, for example, a water-soluble wax, as described in EP-B-0 323 407 B1, a white solid (e.g. titanium dioxide) being added to the melt in order to reinforce the masking effect of the capsule.

A further aspect of the present invention relates to novel granulates E) which contain a) from 2 to 50% by weight of at least one water-soluble phthalocyanine compound, based on the total weight of the granulate,
b) from 10 to 60% by weight of at least one anionic dispersing agent and/or at least one water-soluble organic polymer, based on the total weight of the granulate,
c) from 15 to 75% by weight of at least one inorganic salt and/or at least one low-molecular-weight organic acid or a salt thereof, based on the total weight of the granulate,
d) from 0 to 10% by weight of at least one further additive, based on the total weight of the granulate, and
e) from 3 to 15% by weight water, based on the total weight of the granulate, with the proviso that they do not contain ethoxylated stearyidiphenyloxyethyldiethyltriamine.

All the preferences mentioned hereinbefore apply to the novel granulates E) according to the invention.

A further aspect of the present invention relates to novel preferred granulates E) which contain a) from 4 to 30% by weight of at least one water-soluble phthalocyanine compound,
b) from 12 to 60% by weight of at least one anionic dispersing agent and/or at least
c) from 20 to 75% by weight of at least one inorganic salt and/or at least one low-molecular-weight organic acid or a salt thereof,
d) from 0 to 5% by weight of at least one further additive, and
e) from 3 to 15% by weight water, based on the total weight of the granulate, with the proviso that they do not contain ethoxylated stearyldiphenyloxyethyldiethyltriamine.

A further aspect of the present invention relates to novel, more especially preferred, granulates E) which contain a) from 5 to 20% by weight of at least one water-soluble phthalocyanine compound,
b) from 12 to 55% by weight of at least one anionic dispersing agent and/or at least one water-soluble organic polymer,
c) from 25 to 70% by weight of at least one inorganic salt and/or at least one low-molecular-weight organic acid or a salt thereof,
d) from 0 to 5% by weight of at least one zeolite compound and, where appropriate, further additives, and
e) from 3 to 15% by weight water, based on the total weight of the granulate, with the proviso that they do not contain ethoxylated stearyidiphenyloxyethyldiethyltriamine.

A further aspect of the present invention relates to novel, likewise more especially preferred, granulates E) which contain a) from 2 to 50% by weight of at least one water-soluble phthalocyanine compound of formula (2a), (3), (4), (5), (6) and/or (7) defined above, and
b) from 10 to 60% by weight of at least one anionic dispersing agent from the group consisting of condensation products of naphthalene-sulfonic acid with formaldehyde; sodium salts of polymerised organic sulfonic acids; (mono-/di-)alkylnaphthalenesulfonates; polyalkylated polynuclear arylsulfonates; sodium salts of polymerised alkylbenzenesulfonic acids; lignosulfonates; oxylignosulfonates and condensation products of naphthalenesulfonic acid with a polychloromethylbiphenyl;
   and/or at least one water-soluble organic polymer from the group consisting of carboxymethyl cellulose; polyacrylamides; polyvinyl alcohols; polyvinylpyrrolidones; gelatins; hydrolysed polyvinyl acetates; copolymers of polyaspartic acid; polyacrylates and polymethacrylates, and
c) from 15 to 75% by weight of at least one inorganic salt and/or at least one low-molecular-weight organic acid or a salt thereof from the group consisting of carbonates; hydrogen carbonates; phosphates; polyphosphates; sulfates; silicates; sulfites; borates; halides; pyrophosphates; aliphatic carboxylic acids having a total number of from 1 to 12 carbon atoms, which are unsubstituted or substituted by hydroxy and/or by amino; aminopolycarboxylates; phytates; phosphonates; aminopolyphosphonates; aminoalkylenepoly-(alkylenephosphonates); polyphosphonates; polycarboxylates, water-soluble polysiloxanes, and water-soluble salts used in washing agent and/or washing agent additive formulations, and
d) from 0 to 10% by weight of at least one further additive from the group consisting of wetting agents; disintegrants; fillers; water-insoluble or water-soluble dyes or pigments; dissolution accelerators; optical brighteners; aluminium silicates; talc; kaolin; $TiO_2$; $SiO_2$; and magnesium trisilicate, and
e) from 3 to 15% by weight water, based on the total weight of the granulate, with the proviso that they do not contain ethoxylated stearyldiphenyloxyethyldiethyltriamine.

Preferred granulates are as defined hereinbefore, with the proviso that they are not encapsulated and have a substantially homogeneous distribution of ingredients.

All the preferences described hereinbefore for the granulate E) in the washing agent formulation according to the invention apply to constituents a) to e) of the novel granulate according to the invention.

The following Examples serve to illustrate the invention, without limiting the invention thereto. For that purpose, on the one hand, compositions and the preparation of solutions comprising the phthalocyanine compounds are described and, on the other hand, it is described how, using different technologies, those solutions are further processed in order to prepare the granulates according to the invention. Unless otherwise specified, parts and percentages are based on weight. Temperatures are, unless otherwise specified, in degrees Celsius.

Composition of, and Preparation of, Solutions of Phthalocyanine Compounds:

EXAMPLE 1

564 g of an aqueous solution of an aluminium phthalocyanine compound, which solution has been purified of organic by-products by membrane separation procedures and has a solids content of 19.5% by weight, are introduced into a glass beaker. To that solution there are added 1857 g of an aqueous solution containing 541 g of an anionic dispersing agent (condensation product of naphthalenesulfonic acid and formaldehyde) and 270 g of sodium sulfate. The aqueous solution is homogenised by stirring at 25° C. for 1 hour. A solution having a solids content of 38% is obtained, the proportions in the dissolved material being 12% by weight of the phthalocyanine compound, 59% by weight of the dispersing agent/polymer and 29% by weight of the salt.

EXAMPLES 2-11

The following solutions of phthalocyanine compounds are prepared by the same method. The phthalocyanine solutions used were purified of organic by-products by membrane separation procedures. Where a zeolite or cellulose are used as additives, they can be suspended in the aqueous solution of phthalocyanine compound, dispersing agent/polymer and salt. Table 1 gives the solids content and the percentage proportions of the respective components in the dissolved solids.

EXAMPLE 12

560 g of an aqueous solution of a zinc phthalocyanine compound, which solution has been purified of organic by-products by membrane separation procedures and has a solids content of 12.5% by weight, are introduced into a glass beaker and heated to 40° C. A solution of 160 g of a dry pulverulent anionic dispersing agent (condensation product of formaldehyde with naphthalenesulfonic acid) and 50 g of a maltodextrin 1613 g of water is added to the heated solution. Then 300 g of sodium sulfate, 160 g of sodium citrate and 100 g of sodium tripolyphosphate are added in portions to the solution and finally 200 g of a previously prepared aqueous polyaspartic acid solution (solids content: 20% by weight) are added. The solution obtained has a solids content of 28% and is stirred further at 40° C. until the solids have completely dissolved. The proportions of the phthalocyanine compound, dispersing agent/polymer and salts are 8% by weight, 28% by weight and 64% by weight, respectively.

EXAMPLES 13 TO 22

Solutions having the following compositions are prepared by the same method as in Example 12. The phthalocyanine solutions used were purified of organic by-products by membrane separation procedures. Where a zeolite or cellulose are used as additives, they can be suspended in the aqueous solution of phthalocyanine compound, dispersing agent/polymer and salt. Table 2 below gives the percentage proportions (% by weight) of the respective components in the solids content.

TABLE 1

Examples 2-11

| | Example | | | | | | | | | |
|---|---|---|---|---|---|---|---|---|---|---|
| | 2 | 3 | 4 | 5 | 6 | 7 | 8 | 9 | 10 | 11 |
| a) Phthalocyanine compound | | | | | | | | | | |
| Aluminium phthalocyanine | 11 | | 10 | 5 | 3 | 5 | 8 | 11 | | 7 |
| Zinc phthalocyanine | | 12 | 8 | 2.4 | 12 | 10 | 8 | | 10 | 3 |
| b) Dispersing agent/polymer | | | | | | | | | | |
| Sodium salt of polymerised alkylnaphthalenesulfonic acid | | | 25 | | | | | | | |
| Condensation product of formaldehyde with naphthalenesulfonic acid | 13 | | | | 52 | | | 16 | 39 | |
| Oxylignosulfonate, sodium salt | | | | | | | | | | |
| Alkylnaphthalenesulfonic acid, sodium salt | | | | 31 | | | | | | |
| Dinaphthylmethanesulfonic acid, sodium salt | | | | | | | | | | |
| Sodium lignosulfonate | | | 23 | 31 | | | | | | |
| Methylene-linked condensation product of arylsulfonic acids and hydroxyarylsulfonic acids | | 9 | 2 | | | 17 | 13 | 12 | | 51 |
| Maltodextrin | 14 | 4 | | | | 6 | | | | |
| c) Salt/acid | | | | | | | | | | |
| Sodium sulfate | 49 | 45 | | 30 | 32 | 36 | 71 | 61 | 45 | 39 |
| Sodium carbonate | | | 11 | | | | | | | |
| Sodium citrate | | 30 | | | | 18 | | | | |
| Sodium phosphate | | | 12 | | | 8 | | | | |
| Polyphosphate, sodium salt | 13 | | | | 1 | | | | 6 | |
| Sodium chloride | | | 9 | | | | | | | |
| d) Additives | | | | | | | | | | |
| Fibrous cellulose | | | | 0.6 | | | | | | |
| Solids content of the solutions (% by weight) | 28 | 24 | 30 | 33 | 32 | 31 | 23 | 25 | 27 | 33 |

TABLE 2

| Examples 13-22 | | | | | | | | | | |
|---|---|---|---|---|---|---|---|---|---|---|
| | Example | | | | | | | | | |
| | 13 | 14 | 15 | 16 | 17 | 18 | 19 | 20 | 21 | 22 |
| a) Phthalocyanine compound | | | | | | | | | | |
| Aluminium phthalocyanine | 11 | 6 | 4 | | 13 | 5 | 6 | 4 | 5 | 2 |
| Zinc phthalocyanine | 10 | 3 | 14 | 15 | | 6 | | 5 | 4.2 | 9 |
| b) Dispersing agent/polymer | | | | | | | | | | |
| Sodium salt of polymerised alkylnaphthalenesulfonic acid | | | | | | | 16 | | | |
| Condensation product of formaldehyde with naphthalenesulfonic acid | | 50 | | | 14 | | 27 | | 50 | |
| Oxylignosulfonate, sodium salt | | | | | | | | 16 | | |
| Alkylnaphthalenesulfonic acid, sodium salt | | | | | | | | 12 | | 7.4 |
| Sodium lignosulfonate | 23 | | | | | | | | | |
| Dinaphthylmethanesulfonic acid, sodium salt | | | | | | 1 | | 5 | | |
| Methylene-linked condensation product of arylsulfonic acids and hydroxyarylsulfonic acids | 25 | | | 14 | | 10 | | | 8.8 | 30 |
| Maltodextrin | | | | 9 | 10 | | 11 | | | |
| Polyaspartic acid | | | 12 | 2 | | 4 | | | | |
| Polyvinyl alcohol | | | | | | | | 3 | | |
| Vinylpyrrolidone/vinyl acetate copolymer | | | | | | | 1 | | | |
| Carboxymethyl cellulose | | | | | 2 | | | | | |
| Polyacrylate | 3 | | | | | | | | | |
| Polyacrylamide | | | | | | | | 1 | | |
| Gelatin | | | | | | | 2 | | | |
| c) Salt/acid | | | | | | | | | | |
| Sodium sulfate | 18 | 37 | 70 | 36 | 35 | 74 | 19 | 15 | 29 | 45 |
| Sodium citrate | 6 | | | 16 | 16 | | | 20 | | 5.5 |
| Sodium phosphate | | 4 | | | | | 8 | | | |
| Polyphosphate, sodium salt | 1 | | | 8 | 10 | | | 4 | | |
| Sodium chloride | 3 | | | | | | 10 | 15 | | |
| d) Additives | | | | | | | | | | |
| Zeolite | | | | | | | | | 3 | 1.1 |
| Solids content of the solutions (% by weight) | 35 | 32 | 22 | 24 | 25 | 23 | 30 | 24 | 28 | 26 |

EXAMPLES 23-70

Preparation of Granulates from the Solutions of Examples 1 to 22

Preparation of the granulates is carried out, as mentioned already, by removing all water, except for the residual moisture, from the solutions prepared above, by means of a drying step. Merely by simply drying the solutions in a vacuum cabinet and comminuting the resulting solid in a mixer, followed by sieving, particles having very good dissolution characteristics can be obtained. Preferred granulation methods consist of drying and simultaneous granulation in a spray-dryer, a disc tower, a bench fluidised spray-dryer or in a fluidised bed granulator. The Examples that follow illustrate the invention, without limiting it thereto.

EXAMPLE 23

The solution prepared in Example 1, consisting of phthalocyanine compound, salt and dispersing agent, is spray-dried in a spray-dryer equipped with a single nozzle. The inlet air temperature is 190° C. with an exhaust air temperature of 105° C. The product obtained is a free-flowing granulate having an average particle size of 70 μm and a bulk density of 520 g/l with a residual water content of 6% by weight. The granulate thereby prepared contains 11% by weight aluminium phthalocyanine compound, 56% by weight dispersing agent and 27% by weight salt.

EXAMPLES 24-33

Using the same method as in Example 23, granulates are prepared from some of the solutions described in Examples 2 to 22 by spray-drying, the compositions of the granulates being given in Table 3. The granulates are free-flowing with an average particle diameter in the range 50-80 μm and have a bulk density of 500-550 g/l.

TABLE 3

| Examples 24-33 | | | | | | |
|---|---|---|---|---|---|---|
| Ex. | Solution from Ex. | a) Phthalocyanine, % by weight | b) Disp./pol., % by weight | c) Salt/acid, % by weight | d) Additive, % by weight | Water, % by weight |
| 24 | 2 | 10 | 25 | 58 | — | 7 |
| 25 | 5 | 7 | 55 | 32 | 1 | 5 |

TABLE 3-continued

| Examples 24-33 | | | | | | |
|---|---|---|---|---|---|---|
| Ex. | Solution from Ex. | a) Phthalocyanine, % by weight | b) Disp./pol., % by weight | c) Salt/acid, % by weight | d) Additive, % by weight | Water, % by weight |
| 26 | 6 | 14 | 48 | 30 | — | 8 |
| 27 | 8 | 15 | 12 | 65 | — | 8 |
| 28 | 10 | 10 | 37 | 49 | — | 4 |
| 29 | 11 | 9 | 47 | 36 | — | 8 |
| 30 | 13 | 20 | 48 | 26 | — | 6 |
| 31 | 17 | 12 | 24 | 57 | — | 7 |
| 32 | 19 | 6 | 53 | 34 | — | 7 |
| 33 | 21 | 9 | 55 | 27 | 3 | 6 |

EXAMPLE 34

Preparation of the granulates is carried out by spray-drying the solutions described in Examples 1 to 22. In contrast to the method of Examples 23 to 33, the fines produced during the drying process are continuously separated off from the exhaust air stream and passed directly into the spray cone of the nozzle tower by means of a gas stream. The granulates thereby produced are much coarser and also denser than those of Examples 22 to 33 and have a much reduced fines content (less than 5% of particles below 20 μm). The average particle size is 110 μm with a bulk density of 540-580 g/l.

EXAMPLE 35

The solution prepared in Example 3, consisting of phthalocyanine compound, polymer, salt and dispersing agent, is spray-dried in a drying tower equipped with a disc atomiser. The inlet air temperature is 205° C. with an exhaust air temperature of 102° C. The product obtained is a free-flowing granulate having an average particle size of 65 μm and a bulk density of 510 g/l with a residual water content of 7% by weight. The granulate thereby prepared contains 12% by weight dispersing agent/polymer, 70% by weight salt and 11% by weight zinc phthalocyanine compound.

EXAMPLES 36-43

Using the same method as in Example 35, granulates are prepared from some of the solutions described in Examples 1 to 22 by spray-drying in a disc tower. The granulates are free-flowing with an average particle diameter of 70 μm and have a bulk density of 520-540 g/l. Their compositions are given in Table 4.

TABLE 4

| Examples 36-43 | | | | | | |
|---|---|---|---|---|---|---|
| Ex. | Solution from Ex. | a) Phthalocyanine, % by weight | b) Disp./pol., % by weight | c) Salt/acid, % by weight | d) Additive, % by weight | Water, % by weight |
| 36 | 5 | 7 | 53 | 31 | 1 | 8 |
| 37 | 7 | 14 | 22 | 58 | — | 6 |
| 38 | 8 | 15 | 13 | 68 | — | 4 |
| 39 | 9 | 10 | 26 | 57 | — | 7 |
| 40 | 14 | 8 | 46 | 38 | — | 8 |
| 41 | 15 | 17 | 12 | 67 | — | 4 |
| 42 | 17 | 12 | 25 | 58 | — | 5 |
| 43 | 22 | 10 | 35 | 48 | 1 | 6 |

EXAMPLE 44

The solution prepared in Example 11 is granulated in a bench fluidised spray-dryer. In the first phase of the granulation process, nuclei are built up in the fluidised bed (inlet air temperature 200° C., bed temperature 95° C.). Once sufficient nuclei have been built up in the bed, the bed temperature is lowered to about 48° C. in order to initiate granulation. Granulation of the entire solution is carried out in a range for the bed temperature of from 47 to 50° C. The granulate obtained has a residual moisture content of 9% at the outlet from the granulator and is subsequently dried in a continuously operating fluid bed with warm air to a desired value of 6%. The product obtained is a free-flowing granulate having an average particle size of 130 μm and a bulk density of 610 g/l, with proportions of 9% by weight phthalocyanine compound, 48% by weight dispersing agent/polymer and 37% by weight salt in the solid material.

EXAMPLES 45-57

Using the same method as in Example 44, granulates are prepared from solutions of Examples 1 to 22 by granulating in a bench fluidised spray-dryer and, where appropriate, subsequently drying in a continuously operated fluid bed. The granulates obtained are free-flowing with an average particle diameter of around 120-150 μm and, depending on the composition of the active-ingredient-containing solution and the granulation parameters, have a bulk density of 500-800 g/l. The compositions of the granulates are listed in Table 5.

TABLE 5

| Examples 45-57 | | | | | | |
|---|---|---|---|---|---|---|
| Ex. | Solution from Ex. | a) Phthalocyanine, % by weight | b) Disp./pol., % by weight | c) Salt/acid, % by weight | d) Additive, % by weight | Water, % by weight |
| 45 | 1 | 11 | 54 | 27 | — | 8 |
| 46 | 2 | 10 | 24 | 55 | — | 11 |
| 47 | 4 | 17 | 48 | 30 | — | 5 |
| 48 | 5 | 7 | 53 | 31 | 1 | 8 |
| 49 | 6 | 14 | 49 | 31 | — | 6 |
| 50 | 9 | 10.5 | 27 | 58 | — | 4.5 |
| 51 | 12 | 7 | 26 | 60 | — | 7 |
| 52 | 13 | 19 | 47 | 26 | — | 8 |
| 53 | 14 | 8 | 46 | 38 | — | 8 |
| 54 | 16 | 14 | 23 | 55 | — | 8 |
| 55 | 18 | 11 | 14 | 70 | — | 5 |
| 56 | 20 | 9 | 35 | 51 | — | 5 |
| 57 | 21 | 9 | 55 | 27 | 3 | 6 |

EXAMPLE 58

A portion of the solution prepared in Example 22, consisting of phthalocyanine compound, salt, dispersing agent and zeolite, is dried in vacuo for 24 hours and the solid obtained is comminuted in a laboratory mixer. The product obtained is transferred to a laboratory fluidised bed granulator. (STREA-1, Aeromatic AG, Bubendorf, Switzerland) as granulating nuclei and fluidised by means of warm air (about 65° C.) flowing in through the perforated tray. The solution of Example 6 is continuously sprayed into that fluidised bed using a binary nozzle. After about 120 minutes and after the introduction of about 4000 g of solution, granulation is terminated by stopping the introduction of solution. The granulates obtained are dried in the same apparatus, using warm air at 80° C., to a residual moisture content of 8% by weight. After discharging the product, the fines are removed from the granulate by sieving. A free-flowing granulate is obtained having an average particle size of 310 μm and a bulk density of 680 g/l. The proportions in the solid material are 10% by weight for the phthalocyanine compounds, 34% by weight for the dispersing agents, 47% by weight for the salts and 1% by weight for the zeolite.

EXAMPLES 59-70

Using the same method as in Example 58, granulates are prepared from solutions of Examples 1 to 21. These granulates are free-flowing with an average particle diameter of around 220-350 μm and have a bulk density of 600-750 g/l. The compositions of the granulates are given in Table 6.

TABLE 6

| Examples 5-970 | | | | | | |
|---|---|---|---|---|---|---|
| Ex. | Solution from Ex. | a) Phthalocyanine, % by weight | b) Disp./pol., % by weight | c) Salt/acid, % by weight | d) Additive, % by weight | Water, % by weight |
| 59 | 1 | 11 | 55 | 27 | — | 7 |
| 60 | 3 | 11 | 12 | 68 | — | 9 |
| 61 | 4 | 17 | 47 | 30 | — | 6 |
| 62 | 5 | 7 | 53 | 31 | 1 | 8 |
| 63 | 6 | 14 | 48 | 31 | — | 7 |
| 64 | 9 | 10 | 26 | 56 | — | 8 |
| 65 | 10 | 9 | 35 | 45 | — | 11 |
| 66 | 12 | 7 | 25 | 56 | — | 12 |
| 67 | 13 | 20 | 48 | 26 | — | 6 |
| 68 | 14 | 9 | 48 | 39 | — | 4 |
| 69 | 19 | 6 | 52 | 34 | — | 8 |
| 70 | 21 | 9 | 55 | 27 | 3 | 6 |

Washing Agent Preparations Comprising the Granulates According to the Invention

Examples 71 to 88 illustrate the use of the granulates according to the invention in washing agent preparations, without limiting it thereto.

TABLE 7

| Examples 71-80 | | | | | | | | | | |
|---|---|---|---|---|---|---|---|---|---|---|
| | Examples | | | | | | | | | |
| | 71 | 72 | 73 | 74 | 75 | 76 | 77 | 78 | 79 | 80 |
| Constituents (% by weight) A) | | | | | | | | | | |
| Sodium salt of lauryl benzenesulfonic acid | 10 | 10 | 10 | 10 | 10 | 10 | 10 | 10 | 10 | 10 |
| Sodium lauryl ether sulfate (AES) | 3 | 3 | 3 | 3 | 3 | 3 | 3 | 3 | 3 | 3 |

TABLE 7-continued

| Examples 71-80 | | | | | | | | | | |
|---|---|---|---|---|---|---|---|---|---|---|
| | Examples | | | | | | | | | |
| | 71 | 72 | 73 | 74 | 75 | 76 | 77 | 78 | 79 | 80 |
| B) | | | | | | | | | | |
| Neodol 23-6.5E (alcohol ethoxylate) | 4 | 4 | 4 | 4 | 4 | 4 | 4 | 4 | 4 | 4 |
| C) | | | | | | | | | | |
| Zeolite A (sodium aluminium silicate) | 25 | 20 | 22 | 35 | 10 | 25 | | 32 | 25 | |
| Sodium tripolyphosphate | | 10 | | | 30 | | 35 | | 5 | 32 |
| D) | | | | | | | | | | |
| Sodium percarbonate | 20 | 20 | 20 | 5 | | 20 | | | | |
| Sodium perborate | | | | | | | 20 | | 20 | 20 |
| NOBS (p-nonanoyl-oxybenzenesulfonate) | | | | | | 3 | 3 | | 3 | |
| E) | | | | | | | | | | |
| Granulates, Ex. 23-70 | 0.03 | 0.01 | 0.01 | 0.02 | 0.02 | 0.005 | 0.02 | 0.005 | 0.01 | 0.02 |
| F) | | | | | | | | | | |
| Perfume | 0.1 | 0.1 | 0.1 | 0.1 | 0.1 | 0.1 | 0.1 | 0.1 | 0.1 | 0.1 |
| Cellulase | 1.5 | | 1.5 | 1.5 | 1.5 | | | | | |
| Protease | | 1.5 | | | | 1.5 | 1.5 | 1.5 | 1.5 | 1.5 |
| Polycarboxylate | | 4 | | | | 4 | 4 | 4 | 4 | 4 |
| Carboxymethyl cellulose | 2 | 2 | 2 | 2 | 2 | 2 | 2 | 2 | 2 | 2 |
| Sodium sulfate | 15 | 13 | 18 | 25 | 22 | 20 | 9 | 25 | 8 | 10 |
| Sodium carbonate | 10 | 7 | 10 | 7 | 7 | | 5 | 13 | 8 | 6 |
| TAED (tetraacetyl-ethylenediamine) | 3 | 3 | 3 | 1 | | | | | | 3 |

Further additives in small amounts (foam inhibitors etc.) and the residual moisture content of the washing agent formulation make the composition up to 100%.

TABLE 8

| Examples 81-88 | | | | | | | | |
|---|---|---|---|---|---|---|---|---|
| | Examples | | | | | | | |
| | 81 | 82 | 83 | 84 | 85 | 86 | 87 | 88 |
| Sodium salt of lauryl benzenesulfonic acid | 8% | 8% | 8% | 8% | 8% | 8% | 8% | 8% |
| Sodium lauryl ether sulfate (AES) | 3% | 3% | 3% | 3% | 3% | 3% | 3% | 3% |
| Neodol 23-6.5E (non-ionic alcohol ethoxylate) | 5% | 5% | 5% | 5% | 5% | 5% | 5% | 5% |
| Zeolite A | 20% | 20% | 20% | 20% | 20% | 20% | 20% | 20% |
| Polycarboxylate (co-builder) | 5% | 5% | 5% | 5% | 5% | 5% | 5% | 5% |
| Sodium carbonate | 18% | 18% | 18% | 18% | 18% | 18% | 18% | 18% |
| Sodium silicate | 4% | 4% | 4% | 4% | 4% | 4% | 4% | 4% |
| Sodium sulfate | 5% | 5% | 5% | 5% | 5% | 5% | 5% | 5% |
| Hydroxyethanediphosphonic acid (complexer) | 0.5% | 0.5% | 0.5% | 0.5% | 0.5% | 0.5% | 0.5% | 0.5% |
| Cellulase | 1.5% | 1.5% | | 1.5% | 1.5% | | 1.5% | 1.5% |
| Protease | | | 1.5% | | | 1.5% | | |
| Carboxymethyl cellulose | 1% | 1% | 1% | 1% | 1% | 1% | 1% | 1% |
| Sodium perborate monohydrate | 15% | 15% | 15% | 15% | 15% | 15% | 15% | 15% |
| TAED | 5% | 5% | 5% | 5% | 5% | 5% | 5% | 5% |
| Soap | 2% | 2% | 2% | 2% | 2% | 2% | 2% | 2% |
| Granulate E) | 0.03 | 0.005 | 0.02 | 0.008 | 0.01 | 0.03 | 0.02 | 0.02 |

Further additives in small amounts and the residual moisture content of the washing agent formulation make the composition up to 100%.

What is claimed is:

1. A formulation comprising at least one granulate containing a) from 5 to 20% by weight of at least one water-soluble phthalocyanine compound, based on the total weight of the granulate, b) from 12 to 55% by weight of at least one anionic dispersing agent and/or at least one water-soluble organic polymer, based on the total weight of the granulate, c) from 25 to 70% by weight of at least one inorganic salt and/or at least one low-molecular-weight organic acid or a salt thereof, based on the total weight of the granulate, d) from 0 to 10% by weight of at least one further additive, based on the total weight of the granulate, and e) from 3 to 15% by weight water, based on the total weight of the granulate;

where the phthalocyanine compound is of formula (1a)

$$[Me]_q[PC]\{[Q_1]_r^+A_s^-\} \quad (1a)$$

wherein

PC is the phthalocyanine ring system;

Me is Zn; Fe(II); Ca; Mg; Na; K; $A_1$-$Z_1$; Si(IV); P(V); Ti(IV); Ge(IV); Cr(VI); Ga(III); Zr(IV); In(III); Sn(IV) or Hf(VI);

$Z_1$ is a halide ion, sulfate ion, nitrate ion, acetate ion or hydroxy ion;

q is 0, 1 or 2;

r is from 1 to 4;

$Q_1$ is a sulfo or carboxy group; or is a radical of formula —$SO_2X_2$—$R_6$—$X_3^+$; —O—$R_6$—$X_3^+$; or —$(CH_2)_t$—$Y_1^+$;

wherein $R_6$ is branched or unbranched $C_1$-$C_8$alkylene; or 1,3- or 1,4-phenylene;

$X_2$ is —NH—; or —N—$C_1$-$C_5$alkyl-;

$X_3^+$ is a group of formula

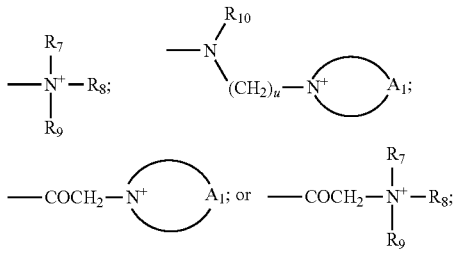

and, in the case where $R_6$=$C_1$-$C_8$alkylene, may also be a group of formula

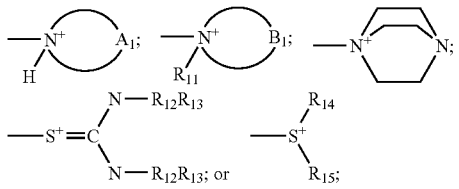

$Y_1^+$ is a group of formula

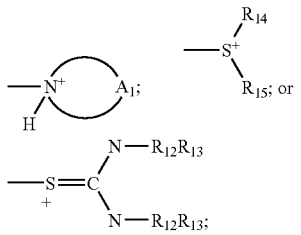

t is 0 or 1;

in which above formulae, $R_7$ and $R_8$ are each independently of the other $C_1$-$C_6$alkyl;

$R_9$ is $C_1$-$C_6$alkyl; $C_5$-$C_7$cycloalkyl; or $NR_{11}R_{12}$;

$R_{10}$ and $R_{11}$ are each independently of the other $C_1$-$C_5$alkyl;

$R_{12}$ and $R_{13}$ are each independently of the other hydrogen or $C_1$-$C_5$alkyl;

$R_{14}$ and $R_{15}$ are each independently of the other unsubstituted or hydroxy-, cyano-, carboxy-, $C_1$-$C_6$alkoxy-carbonyl-, $C_1$-$C_6$alkoxy-, phenyl-, naphthyl- or pyridyl-substituted $C_1$-$C_6$alkyl;

u is from 1 to 6;

$A_1$ is the balance of an aromatic 5- to 7-membered nitrogen heterocycle which may contain one or two further nitrogen atoms as ring members, and $B_1$ is the balance of a saturated 5- to 7-membered nitrogen heterocycle which may contain 1 or 2 further nitrogen, oxygen and/or sulfur atoms as ring members;

$A^-$ is an organic or inorganic anion, and s in the case of monovalent anions $A^-$ is equal to r and in the case of polyvalent anions is ≦r, it being necessary for $A_s^-$ to balance the positive charge; and when r≠1, the radicals $Q_1$ may be identical or different, and wherein the phthalocyanine ring system may also contain further solubility-imparting groups and where the inorganic salts are selected from the group consisting of alkali metal salts of carbonates, hydrogen carbonates, phosphates, polyphosphates, sulfates, silicates, halides and pyrophosphates, and where the low-molecular-weight organic acids and salts thereof are selected from the group consisting of oxalic acid, tartaric acid, acetic acid, propionic acid, succinic acid, maleic acid, citric acid, formic acid, gluconic acid, p-toluenesulfonic acid, terephthalic acid, benzoic acid, phthalic acid, acrylic acid, and salts thereof.

2. A formulation according to claim 1, wherein the granulate comprises, as phthalocyanine compound, at least one water-soluble Zn(II), Fe(II), Ca(II), Mg(II), Na(I), K(I), Al, Si(IV), P(V), Ti(IV), Ge(IV), Cr(VI), Ga(III), Zr(IV), In(III), Sn(IV) or Hf(VI) phthalocyanine compound.

3. A formulation according to claim 1, wherein the granulate comprises at least one phthalocyanine compound of formula

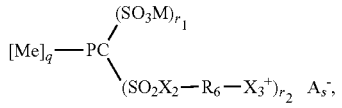

(2a)

wherein

Me, q, PC, $X_2$, $X_3$ and $R_6$ are as defined for formula (1a),

M is hydrogen; or an alkali metal ion, ammonium ion or amine salt ion;

and the sum of the numbers $r_1$ and $r_2$ is from 1 to 4, and $A_s^-$ exactly balances the positive charge of the remainder of the molecule, or of formula $$[Me]_q—[Pc]—[SO_2NHR_6'—X_3'^+A'^-]_r, \quad (3)$$

wherein

Me, q and PC are as defined for formula (1a), $R_6'$ is $C_2$-$C_6$alkylene;

r is a number from 1 to 4;

$X_3'$ is a group of formula

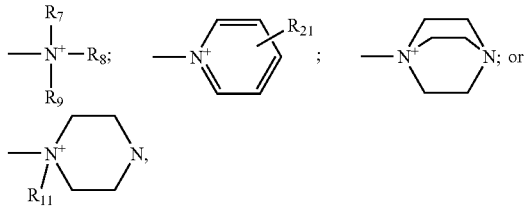

wherein $R_7$ and $R_8$ are each independently of the other unsubstituted or hydroxy-, cyano-, halo- or phenyl-substituted $C_1$-$C_4$alkyl;

$R_9$ is $R_7$; cyclohexyl or amino;

$R_{11}$ is $C_1$-$C_4$alkyl;

$R_{21}$ is $C_1$-$C_4$alkyl; $C_1$-$C_4$alkoxy; halogen; carboxy; $C_1$-$C_4$alkoxy-carbonyl or hydroxy; and $A'^{-}$ is a halide ion, alkylsulfate ion or arylsulfate ion;

it being possible for the radicals —$SO_2NHR'_6$—$X_3^{r+}A^{-}$ to be identical or different.

4. A formulation according to claim 1, wherein the granulate comprises at least one phthalocyanine compound of formula (7)

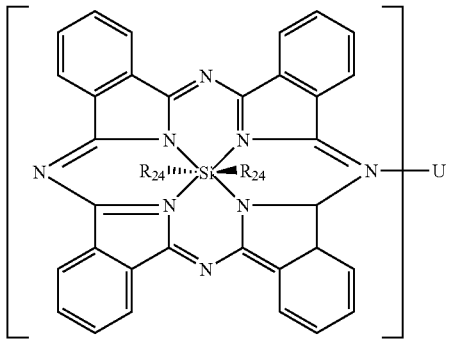

wherein $R_{24}$ is hydroxy; $C_1$-$C_{22}$alkyl; branched $C_4$-$C_{22}$alkyl; $C_1$-$C_{22}$alkenyl; branched $C_4$-$C_{22}$alkenyl or a mixture thereof; $C_1$-$C_{22}$alkoxy; a sulfo or carboxy radical; a radical of formula

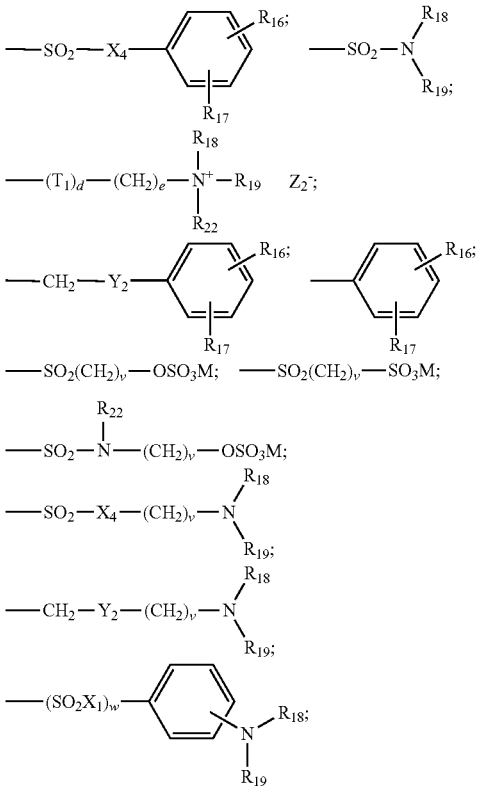

-continued

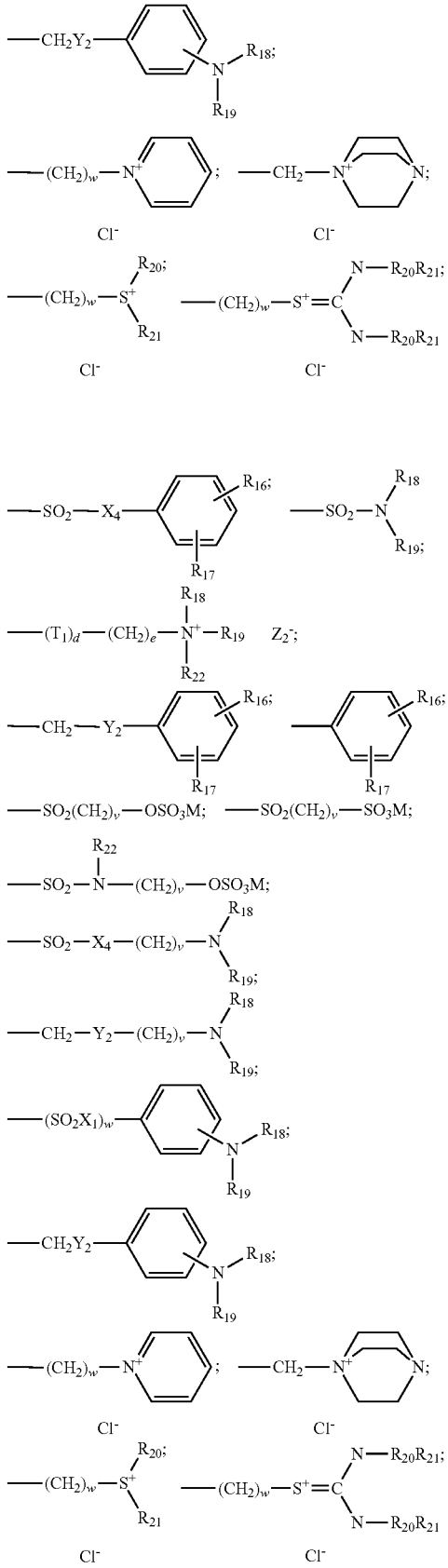

a branched alkoxy radical of formula

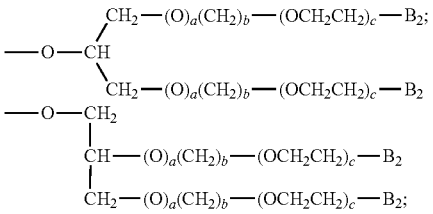

an alkylethyleneoxy unit of formula $-(T_1)_d-(CH_2)_b(OCH_2CH_2)_a—B_3$ or an ester of formula $COOR_{23}$; and U is $[Q_1]_r^+A_s^-$;

$R_{16}$, $R_{17}$, $R_{18}$, $R_{19}$, $R_{20}$, $R_{21}$, $R_{22}$, $R_{23}$, $B_2$, $B_3$, M, $Q_1$, $A_s$, $T_1$, $X_1$, $X_4$, $Y_2$, $Z_2^-$, a, b, c, d, e, r, v and w therein being as defined for formulae (1a).

5. A formulation according to claim 1, wherein the granulate comprises, as anionic dispersing agent, one or more condensation products selected from the group consisting of: condensation products of aromatic sulfonic acids and formaldehyde, condensation products of aromatic sulfonic acids with unsubstituted or chlorinated biphenyls or biphenyl oxides and optionally formaldehyde, (mono-/di-)alkylnaphthalenesulfonates, sodium salts of polymerised organic sulfonic acids, sodium salts of polymerised alkylnaphthalenesulfonic acids, sodium salts of polymerised alkylbenzenesulfonic acids, alkylarylsulfonates, sodium salts of alkyl polyglycol ether sulfates, polyalkylated polynuclear arylsulfonates, methylene-linked condensation products of arylsulfonic acids and hydroxyarylsulfonic acids, sodium salts of dialkylsulfosuccinic acids, sodium salts of alkyl diglycol ether sulfates, sodium salts of polynaphthalenemethanesulfonates, ligno- or oxyligno-sulfonates and heterocyclic polysulfonic acids.

6. A formulation according to claim 1, wherein the granulate comprises, as water-soluble polymer, one or more compounds selected from the group consisting of: gelatins, polyacrylates, polymethacrylates, copolymers of ethyl acrylate, methyl methacrylate and ammonium salt of methacrylic acid, polyvinylpyrrolidones, vinylpyrrolidones, vinyl acetates, copolymers of vinylpyrrolidone with long-chain olefins, poly (vinyl-pyrrolidone/dimethylaminoethyl methacrylates), copolymers of vinylpyrrolidone/dimethylaminopropyl methacrylamides, copolymers of vinylpyrrolidone/dimethylaminopropyl acrylamides, quaternised copolymers of vinylpyrrolidones and dimethylaminoethyl methacrylates, terpolymers of inylcaprolactam/vinylpyrrolidone/dimethylaminoethyl methacrylates, copolymers of vinylpyrrolidone and methacrylamidopropyltrimethylammonium chloride, terpolymers of caprolactam/vinylpyrrolidone/dimethylaminoethyl methacrylates, copolymers of styrene and acrylic acid, polycarboxylic acids, polyacrylamides, carboxymethyl cellulose, hydroxymethyl cellulose, polyvinyl alcohols, hydrolysed and non-hydrolysed polyvinyl acetate, copolymers of maleic acid with unsaturated hydrocarbons and also mixed polymerisation products of the mentioned polymers, polyethylene glycol having a molecular weight=4000-20,000, copolymers of ethylene oxide with propylene oxide having a molecular weight >3500, condensation products of alkylene oxides, copolymers of vinylpyrrolidone with vinyl acetate, ethylene oxide-propylene oxide addition products with diamines, polystyrenesulfonic acid, polyethylenesulfonic acid, copolymers of acrylic acid with sulfonated styrenes, gum arabic, hydroxypropyl methylcellulose, sodium carboxymethyl cellulose, hydroxypropyl methylcellulose phthalate, maltodextrin, starch, sucrose, lactose, enzymatically modified and subsequently hydrated sugars, polyaspartic acid and tragacanth.

7. A formulation according to claim 1, wherein the granulate further comprises from 0 to 5% by weight of the at least one further additive, said further additive selected from a wetting agent, a disintegrant, a filler, a water-insoluble or water-soluble dye or pigment, a dissolution accelerator, an optical brightener, a zeolite, talc, powdered cellulose, fibrous cellulose, microcrystalline cellulose, kaolin, $TiO_2$, $SiO_2$ or magnesium trisilicate.

8. A formulation according to claim 1, wherein the granulate has an average particle size of <500 μm.

9. A washing agent composition, washing agent additive or additive concentrate which comprises a formulation according to claim 1.

10. A composition according to claim 9, which is a component of a pre- and/or after-treatment agent, stain-removing salt, washing-power enhancer, fabric conditioner, bleaching agent and/or UV-protection enhancer.

11. A washing agent formulation consisting of

I) from 5 to 70% A) of at least one anionic surfactant and/or B) at least one non-ionic surfactant, based on the total weight of the washing agent formulation, II) from 5 to 60% C) of at least one builder substance, based on the total weight of the washing agent formulation, III) from 0 to 30% D) of at least one peroxide and, optionally, at least one activator, based on the total weight of the washing agent formulation, and IV) from 0.001 to 1 E) of at least one granulate as defined in claim 1, and V) from 0 to 60% F) of at least one further additive, and VI) from 0 to 5% G) water.

12. A process for the preparation of a granulate according to claim 1, wherein firstly an aqueous solution of the phthalocyanine compound is prepared, to which there is added the anionic dispersing agent and/or the polymer or a polymer solution, the salt and, where appropriate, further additives, and stirring is carried out until a homogeneous solution is obtained, and then all the water, with the exception of a residual amount, is removed from the aqueous solution in a drying step, solid particles simultaneously being formed.

13. A process according to claim 12, wherein the phthalocyanine solution is purified of organic by-products by a membrane separation procedure.

14. A granulate as defined in claim 1 with the proviso that it does not contain ethoxylated stearyldiphenyloxyethyldiethyltriamine.

15. A method of treating textiles which comprises contacting them with a formulation according to claim 1.

16. A formulation according to claim 1, wherein component a) comprises a mixture of zinc and aluminium phthalocyanine.

17. A formulation according to claim 1, wherein component b) comprises the condensation product of naphthalene sulfonic acid and formaldehyde.

18. A formulation according to claim 1, wherein component c) comprises alkali metal sulfates.

19. A formulation according to claim 1, wherein component c) comprises sodium sulfate.

20. A formulation according to claim 1 wherein component a) comprises a mixture of zinc and aluminium phthalocyanine, component b) comprises the condensation product of naphthalene sulfonic acid and formaldehyde and component c) comprises alkali metal sulfates.

21. A formulation according to claim 1 wherein component a) comprises a mixture of zinc and aluminium phthalocyanine, component b) comprises the condensation product of naphthalene sulfonic acid and formaldehyde and component c) comprises sodium sulfate.

22. A formulation according to claim 1 comprising at least one granulate containing a) from 5 to 20% by weight based on the total weight of the granulate, of a mixture of zinc and aluminium phthalocyanine compound where Me is Zn and $AlZ_1$, b) from 12 to 55% by weight based on the total weight of the granulate, of the condensation product of naphthalene sulfonic acid and formaldehyde, c) from 25 to 70% by weight based on the total weight of the granulate, of alkali metal sulfates, d) from 0 to 10% by weight of at least one further additive, based on the total weight of the granulate, and e) from 3 to 15% by weight water, based on the total weight of the granulate.

* * * * *